US008547303B2

(12) United States Patent
Weitbruch et al.

(10) Patent No.: US 8,547,303 B2
(45) Date of Patent: Oct. 1, 2013

(54) ACTIVE MATRIX ORGANIC LIGHT EMITTING DISPLAY (AMOLED) DEVICE

(75) Inventors: Sebastien Weitbruch, Kappel (DE); Ingo Tobias Doser, Villingen-Schwenningen (DE); Sylvain Thiebaud, Noyal sur Vilaine (FR)

(73) Assignee: Thomson Licensing, Issy les Moulineaux (FR)

( * ) Notice: Subject to any disclaimer, the term of this patent is extended or adjusted under 35 U.S.C. 154(b) by 1138 days.

(21) Appl. No.: 12/308,725

(22) PCT Filed: Jun. 30, 2007

(86) PCT No.: PCT/EP2007/056385
§ 371 (c)(1),
(2), (4) Date: Dec. 22, 2008

(87) PCT Pub. No.: WO2008/000750
PCT Pub. Date: Jan. 3, 2008

(65) Prior Publication Data

US 2009/0278770 A1 Nov. 12, 2009

(30) Foreign Application Priority Data

Jun. 30, 2006 (EP) ..... 06300737

(51) Int. Cl.
*G09G 3/30* (2006.01)

(52) U.S. Cl.
USPC ..... 345/76; 345/82

(58) Field of Classification Search
USPC ..... 345/76–82; 315/169.1; 348/503
See application file for complete search history.

(56) References Cited

U.S. PATENT DOCUMENTS

| | | | | |
|---|---|---|---|---|
| 5,151,689 | A | 9/1992 | Kabuto et al. | |
| 5,850,269 | A * | 12/1998 | Kim | 349/15 |
| 7,301,517 | B2 | 11/2007 | Hebiguchi et al. | |
| 7,598,936 | B2 | 10/2009 | Hoshino | |
| 2002/0033809 | A1 | 3/2002 | Nakajima | |
| 2003/0043132 | A1 | 3/2003 | Nakamura | |
| 2003/0058196 | A1 * | 3/2003 | Hansen et al. | 345/75.2 |
| 2003/0174106 | A1 | 9/2003 | Tanada et al. | |
| 2006/0012708 | A1 * | 1/2006 | Rosmalen | 348/503 |
| 2006/0044236 | A1 * | 3/2006 | Kim | 345/82 |
| 2006/0197458 | A1 * | 9/2006 | Winters et al. | 315/169.1 |
| 2007/0086090 | A1 * | 4/2007 | Wang et al. | 359/464 |
| 2010/0156947 | A1 * | 6/2010 | Moon et al. | 345/690 |

FOREIGN PATENT DOCUMENTS

| | | |
|---|---|---|
| EP | 1291841 | 3/2003 |
| JP | 242420 | 2/1990 |
| JP | 4147212 | 5/1992 |
| JP | 200223135 | 1/2002 |
| JP | 200232051 | 1/2002 |
| JP | 200330037 | 11/2003 |
| JP | 2005165209 | 6/2005 |

OTHER PUBLICATIONS

Search Report Dated Sep. 13, 2007.

* cited by examiner

*Primary Examiner* — Amare Mengistu
*Assistant Examiner* — Premal Patel
(74) *Attorney, Agent, or Firm* — Robert D. Shedd; Jeffrey M. Navon

(57) ABSTRACT

The present invention relates to an active matrix OLED (Organic Light Emitting Display) device. It comprises a matrix of luminous elements associated to different color components (red, green, blue). According to the invention, the connection of the row driver and/or data driver to the luminous elements of the matrix is modified. Each output of the row driver is connected to luminous element associated to a same color component (red or green or blue).

10 Claims, 17 Drawing Sheets

ACTIVE MATRIX ORGANIC LIGHT EMITTING DISPLAY (AMOLED) DEVICE

This application claims the benefit, under 35 U.S.C. §365 of International Application PCT/EP2007/056385, filed Jun. 26, 2007, which was published in accordance with PCT Article 21(2) on Jan. 3, 2008 in English and which claims the benefit of European patent application No. 06300737.1, filed Jun. 30, 2006.

FIELD OF THE INVENTION

The present invention relates to an active matrix OLED (Organic Light Emitting Display) device. This device has been more particularly but not exclusively developed for video application.

BACKGROUND OF THE INVENTION

The structure of an active matrix OLED or AM-OLED is well known. It comprises:

- an active matrix containing, for each cell, an association of several thin film transistors (TFT) with a capacitor connected to an OLED material; the capacitor acts as a memory component that stores a value during a part of the video frame, this value being representative of a video information to be displayed by the cell during the next video frame or the next part of the video frame; the TFTs act as switches enabling the selection of the cell, the storage of a data in the capacitor and the displaying by the cell of a video information corresponding to the stored data;
- a row or gate driver that selects line by line the cells of the matrix in order to refresh their content;
- a column or source driver that delivers the data to be stored in each cell of the current selected line; this component receives the video information for each cell; and
- a digital processing unit that applies required video and signal processing steps and that delivers the required control signals to the row and column drivers.

Actually, there are two ways for driving the OLED cells. In a first way, each piece of digital video information sent by the digital processing unit is converted by the column drivers into a current whose amplitude is proportional to the video information. This current is provided to the appropriate cell of the matrix. In a second way, the digital video information sent by the digital processing unit is converted by the column drivers into a voltage whose amplitude is proportional to the video information. This current or voltage is provided to the appropriate cell of the matrix.

From the above, it can be deduced that the row driver has a quite simple function since it only has to apply a selection line by line. It is more or less a shift register. The column driver represents the real active part and can be considered as a high level digital to analog converter. The displaying of video information with such a structure of AM-OLED is the following one. The input signal is forwarded to the digital processing unit that delivers, after internal processing, a timing signal for row selection to the row driver synchronized with the data sent to the column drivers. The data transmitted to the column driver are either parallel or serial. Additionally, the column driver disposes of a reference signalling delivered by a separate reference signalling device. This component delivers a set of reference voltages in case of voltage driven circuitry or a set of reference currents in case of current driven circuitry. The highest reference is used for the white and the lowest for the black level. Then, the column driver applies to the matrix cells the voltage or current amplitude corresponding to the data to be displayed by the cells.

In order to illustrate this concept, an example of a voltage driven circuitry is described below. Such a circuitry will also used in the rest of the present specification for illustrating the invention. The driver taken as example uses 8 reference voltages named $V_0$ to $V_7$ and the video levels are built as shown below:

| Video level | Grayscale voltage level | Output voltage |
|---|---|---|
| 0 | V7 | 0.00 V |
| 1 | V7 + (V6 − V7) × 9/1175 | 0.001 V |
| 2 | V7 + (V6 − V7) × 32/1175 | 0.005 V |
| 3 | V7 + (V6 − V7) × 76/1175 | 0.011 V |
| 4 | V7 + (V6 − V7) × 141/1175 | 0.02 V |
| 5 | V7 + (V6 − V7) × 224/1175 | 0.032 V |
| 6 | V7 + (V6 − V7) × 321/1175 | 0.045 V |
| 7 | V7 + (V6 − V7) × 425/1175 | 0.06 V |
| 8 | V7 + (V6 − V7) × 529/1175 | 0.074 V |
| 9 | V7 + (V6 − V7) × 630/1175 | 0.089 V |
| 10 | V7 + (V6 − V7) × 727/1175 | 0.102 V |
| 11 | V7 + (V6 − V7) × 820/1175 | 0.115 V |
| 12 | V7 + (V6 − V7) × 910/1175 | 0.128 V |
| 13 | V7 + (V6 − V7) × 998/1175 | 0.14 V |
| 14 | V7 + (V6 − V7) × 1086/1175 | 0.153 V |
| 15 | V6 | 0.165 V |
| 16 | V6 + (V5 − V6) × 89/1097 | 0.176 V |
| 17 | V6 + (V5 − V6) × 173/1097 | 0.187 V |
| 18 | V6 + (V5 − V6) × 250/1097 | 0.196 V |
| 19 | V6 + (V5 − V6) × 320/1097 | 0.205 V |
| 20 | V6 + (V5 − V6) × 386/1097 | 0.213 V |
| 21 | V6 + (V5 − V6) × 451/1097 | 0.221 V |
| 22 | V6 + (V5 − V6) × 517/1097 | 0.229 V |
| . . . | . . . | . . . |
| 250 | V1 + (V0 − V1) × 2278/3029 | 2.901 V |
| 251 | V1 + (V0 − V1) × 2411/3029 | 2.919 V |
| 252 | V1 + (V0 − V1) × 2549/3029 | 2.937 V |
| 253 | V1 + (V0 − V1) × 2694/3029 | 2.956 V |
| 254 | V1 + (V0 − V1) × 2851/3029 | 2.977 V |
| 255 | V0 | 3.00 V |

A more complete table is given in Annex 1. This table illustrates the output voltage for various input video levels. The reference voltages used are for example the following ones:

| Reference $V_n$ | Voltage (Volts) |
|---|---|
| V0 | 3 |
| V1 | 2.6 |
| V2 | 2.2 |
| V3 | 1.4 |
| V4 | 0.6 |
| V5 | 0.3 |
| V6 | 0.16 |
| V7 | 0 |

Actually, there are three ways for making colour displays:

- a first possibility illustrated by FIG. 1 is to use a white OLED emitter having on top photopatternable colour filters; this type of display is similar to the current LCD displays where the colour is also done by using colour filters; it has the advantage of using one single OLED material deposition and of having a good colour tuning possibility but the efficiency of the whole display is limited by the colour filters.
- a second possibility illustrated by FIG. 2 is to use blue OLED emitters having on top photopatternable colour converters for red and green; such converters are mainly based on materials that absorb a certain spectrum of light and convert it to an other spectrum that is always lower; this type of display has the advantage of using one single OLED material deposition but the efficiency of the whole display is limited by the colour converters; furthermore, blue materials are needed since the spectrum of the light can only be reduced by the converters but the blue materials are always the less efficient both in terms of light emission and lifetime.

a third possibility illustrated by FIG. 3 is to use different OLED emitters for the 3 colours red, green and blue. This type of display requires at least 3 material deposition steps but the emitters are more efficient since not filtered.

The invention is more particularly adapted to the displays of FIG. 3. It can be also used for the other types of display.

The use of three different OLED materials (one par colour) implies that they all have different behaviours. This means that they all have different threshold voltages and different efficiencies as illustrated by FIG. 4. In the example of FIG. 4, the threshold voltage $VB_{th}$ of the blue material is greater than the threshold voltage $VG_{th}$ of the green material that is itself greater than the threshold voltage $VR_{th}$ of the red material. Moreover, the efficiency of the green material is greater than the efficiencies of the red and blue materials. Consequently, in order to achieve a given colour temperature, the gain between these 3 colours must be further adjusted depending on the material colour coordinates in the space. For instance, the following materials are used:

Red (x=0.64; y=0.33) with 6 cd/A and $VR_{th}$=3V

Green (x=0.3; y=0.6) with 20 cd/A and $VG_{th}$=3.3V

Blue (x=0.15; y=0.11) with 4 cd/A and $VR_{th}$=3.5V

Thus a white colour temperature of 6400° K (x=0.313; y=0.328) is achieved by using 100% of the red, 84% of the green and 95% of the blue.

If one driver with only one set of reference signals (voltages or currents) for the 3 colours is used and if the maximum voltage to be applied to the cells is 7 Volts (=$V_{max}$), the voltage range must be from 3V to 7V but only a part of this dynamic can be used and all corrections must be done digitally. Such a correction will reduce the video dynamic of the whole display. FIG. 5 illustrates the final used video dynamic for the 3 colours. More particularly, the FIG. 5 shows the range used for each diode (colour material) in order to have proper colour temperature and black level. Indeed, the minimum voltage $V_{min}$ (=V7 in the previous table) to be applied to the diodes must be chosen equal to 3V to enable switching OFF the red diode and the lowest lighting voltage (=V7+(V6−V7)×9/1175 in the previous table) must be chosen according the blue threshold level to adjust black level. The maximum voltage to be chosen for each diode is adapted to the white colour temperature that means 100% red, 84% green and 95% blue. Finally, it can be seen that only a very small part of the green video range is used.

Since the video levels between 3V and 7V are defined with 256 bits, it means that the green component is displayed with only a few digital levels. The red component uses a bit more gray level but this is still not enough to provide a satisfying picture quality.

A solution is disclosed in the European patent application 05292435.4 filed in the name of Deutsche Thomson-Brandt Gmbh. In this application, a different reference signalling is used to display each of the three colour components. In this solution, the luminous elements are addressed in a way different from the standard addressing.

FIG. 6 illustrates the standard addressing of video data in an AMOLED display. The matrix of luminous elements comprises for example 320×3=960 columns (320 columns per colour) C0 to C959 and 240 rows L0 to L239 like a QVGA display (320×240 pixels). For the sake of simplicity, only 5 rows L0 to L4 and 5 columns C0 to C3 and C959 are shown in this figure. C0 is a column of red luminous elements, C1 is a column of green luminous elements, C2 is a column of blue luminous elements, C3 is a column of red luminous elements and so on. Each output of the row driver is connected to a row of luminous elements of the matrix. The video data that must be addressed to the luminous element belonging to the column Ci and the row Lj is expressed by X(i,j) wherein X designates one of the colour components R, G, B. The video data of the picture to be displayed are processed by a signal processing unit that delivers the video data R(0,0), G(1,0), B(2,0), R(3,0), G(4,0), B(5,0), . . . R(957,0), G(958,0), B(959, 0) for the row of luminous elements L0 and the reference voltages to be used for displaying said video data to a data driver (or column driver) having 960 outputs, each output being connected to a column of the matrix. The same set of reference voltages is used for all the video data. Consequently, to display colours, this standard addressing requires an adjustment of the reference voltages combined with a video adjustment of the three colours but these adjustments does not prevent from having a large loss of the video dynamic as shown in FIG. 5.

The solution presented in the above-mentioned European patent application 05292435.4 is a specific addressing that can be used in a standard active matrix OLED. The idea is to have a set of reference voltages (or currents) for each colour and to address three times per frame the luminous elements of the display such that the video frame is divided into three sub-frames, each sub-frame being adapted to display mainly a dedicated colour by using the corresponding set of reference voltages. The main colour to be displayed as and the set of reference voltages change at each sub-frame.

For example, the red colour is displayed during the first sub-frame with the set of reference voltages dedicated to the red colour, the green colour is displayed during the second sub-frame with the set of reference voltages dedicated to the green colour and the blue colour is displayed during the third sub-frame with the set of reference voltages dedicated to the blue colour.

A little bit different solution is explained in more detail in reference to FIG. 7 that illustrates a possible embodiment. During the first sub-frame, the three components are displayed using the reference voltages adapted to the green component to dispose of a full grayscale dynamic for this component. {V0(G), V1(G), V2(G), V3(G), V4(G), V5(G), V6(G), V7(G)} designates the set of reference voltages dedicated to the green component. The two other components are only partially displayed. So the sub-picture displayed during this sub-frame is greenish/yellowish. During the second sub-frame, the green component is deactivated (set to zero) and the voltages are adapted to dispose of a full dynamic for the red component by using the set of reference voltages dedicated to the red component {V0(R), V1(R), V2(R), V3(R), V4(R), V5(R), V6(R), V7(R)}. The sub-picture displayed during this sub-frame is purplish. Finally during the third sub-frame, the green and red components are deactivated (set to zero) and the voltages are adapted to dispose of a full dynamic for the blue component by using the set of reference voltages dedicated to the blue component {V0(B), V1(B), V2(B), V3(B), V4(B), V5(B), V6(B), V7(B)}.

It is thus possible to adjust the 8 reference voltages (or currents) at each sub-frame. The only particularity is that the lowest reference voltages must be kept equal to the lowest threshold voltage of the three colours. Indeed, displaying a blue component means having red and green components equal to zero, which means equal to V7 that is the lowest reference voltage. So, this voltage must be low enough to have them really black. In the example of FIG. 5, we must have $$V7(R)=V7(B)=V7(G)=VR_{th}.$$

The only additional requirement is the necessity of addressing the matrix three times faster.

FIGS. 8 to 10 illustrates the functioning of the display device during the three sub-frames. In reference to FIG. 8, during the first sub-frame, the video data of the picture to be displayed are converted into voltages to be applied to the luminous elements of the matrix by the data driver that uses the set of reference voltages dedicated to the green component. The set of reference voltages are distributed between 3 volts (=V7(G)=$VR_{th}$) and about 4 volts=V0(G) that is the maximum voltage that can be used for displaying the green component.

An example of reference voltages for the green component is given below:

| Reference $V_n$ | Voltage (Volts) |
|---|---|
| V0 | 4 |
| V1 | 3.85 |
| V2 | 3.75 |
| V3 | 3.45 |
| V4 | 3.2 |
| V5 | 3.1 |
| V6 | 3.05 |
| V7 | 3 |

In reference to FIG. 9, during the second sub-frame, the video data of the picture to be displayed are converted into voltages to be applied to the luminous elements of the matrix by the data driver that uses the set of reference voltages dedicated to the red component. The video data corresponding to the green and red components are set to zero. The set of reference voltages are distributed between 3 volts (=V7(R)=$VR_{th}$) and about 5.4 volts=V0(R) that is the maximum voltage that can be used for displaying the red component.

An example of reference voltages for the red component is given below:

| Reference $V_n$ | Voltage (Volts) |
|---|---|
| V0 | 5.4 |
| V1 | 5.08 |
| V2 | 4.76 |
| V3 | 4.12 |
| V4 | 3.48 |
| V5 | 3.24 |
| V6 | 3.13 |
| V7 | 3 |

In reference to FIG. 10, during the third sub-frame, the video data of the picture to be displayed are converted into voltages to be applied to the luminous elements of the matrix by the data driver that uses the set of reference voltages dedicated to the blue component. The video data corresponding to the green component are set to zero. The set of reference voltages are distributed between 3 volts (=V7(G)=$VR_{th}$) and about 7 volts=V0(B) that is the maximum voltage that can be used for displaying the blue component.

An example of reference voltages for the blue component is given below:

| Reference $V_n$ | Voltage (Volts) |
|---|---|
| V0 | 7 |
| V1 | 6.46 |
| V2 | 5.93 |
| V3 | 4.86 |
| V4 | 3.8 |
| V5 | 3.4 |
| V6 | 3.21 |
| V7 | 3 |

In a more general manner, the colour component having the highest luminosity capabilities (in the present case, the green component) is displayed only in the first sub-frame. The colour component having the lowest luminosity capabilities (in the present case, the blue component) is displayed in the three sub-frames and the colour component having in-between luminosity capabilities (in the present case, the red component) is displayed during two sub-frames.

A drawback of this solution is that it requires addressing the matrix three times faster than a standard addressing. Another drawback is that there is some colour lag on moving edges since different colours are displayed at different time periods (for example Red+Green+Blue during the first sub-frame, Red+Blue during the second sub-frame and only blue during the third sub-frame)

SUMMARY OF THE INVENTION

It is an object of the present invention to propose a solution to reduce one or more of these drawbacks. According to the invention, new AMOLED matrix structures are proposed and these new structures can be used to have different sets of reference voltages (or currents) for different colour components.

This object is solved by a display device comprising

- an active matrix containing an array of luminous elements arranged in n rows and m columns, each luminous element being associated to a colour component among k different colour components of a picture to be displayed, k being greater than 1 and the luminous elements being arranged in groups of k consecutive luminous elements associated to different colour components,
- a first driver having p outputs connected to the active matrix for selecting luminous elements of the matrix; each output of the first driver being connected to a different part of the matrix and the parts of the matrix being selected by the first driver one after the other,
- a second driver having q outputs connected to the active matrix for delivering a signal to each luminous element selected by the first driver, said signal depending on the video information to be displayed by the selected luminous elements; and
- a digital processing unit for delivering video information to the second driver and control signals to the first driver.

According to the invention, each output of the first driver is connected to luminous elements associated to a same colour component, the signal of the video information to be displayed by each of the luminous elements connected to an output of the first driver being delivered by a separate output of the second driver.

Thus, as the different parts of the matrix are selected one after the other and as each part of the matrix is associated to a same colour component (all the luminous elements of a part of the matrix are connected to the same output of the first driver), a set of reference voltages (or currents) associated to this colour component can be selected when said part of matrix is selected.

Several embodiments are possible depending on whether the k luminous elements of each group belong to one and the same row or to one and the same column of luminous elements of the matrix. Several embodiments are also possible depending on the number of outputs of the first and second driver.

In a first embodiment, the k luminous elements of each group belong to one and the same row, the first driver has p=n outputs, the second driver has q=m outputs and each output of the first driver is connected to all luminous elements associated to a same colour component and belonging to k rows of luminous elements of the active matrix.

In a second embodiment, the k luminous elements of each group belong to one and the same row, the first driver has p=k*n outputs, the second driver has q=m/k outputs and each output of the first driver is connected to all luminous elements associated to a same colour component and belonging to a same row of luminous elements of the matrix. Each output of the second driver is connected to the k luminous elements of a same group of luminous elements. In this embodiment, two consecutive outputs of the first driver are connected to luminous elements associated to different colour components.

In a third embodiment which is a variant of the second embodiment, at least two consecutive outputs of the first driver are connected to luminous elements associated to a same colour component.

In a fourth embodiment, the k luminous elements of each group belong to one and the same column of luminous elements of the active matrix, the first driver has p=n/k outputs and the second driver has q=m*k outputs. k outputs of the second driver are connected to luminous elements of a same column, each one of said k outputs being connected to luminous elements associated to a same colour component and each output of the first driver is connected to all luminous elements associated to a same colour component and belonging to a same column of luminous elements and to k rows of luminous elements of the active matrix.

In all these embodiments, the video information delivered to the second driver is based on sets of reference signals, a different set of reference signals being associated to at least two different colour components. The digital processing unit controls the first driver and delivers video information and reference signals to the second driver such that, each time the luminous elements connected to an output of the first driver are selected, the digital processing unit delivers to the second driver the video information of the luminous elements selected by the first driver and the set of reference signals associated to the colour component of these selected luminous elements.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

The idea of the invention is to address at one given time period of the video frame only the luminous elements associated to one colour component by amending the connection of the row driver and the column driver to the active matrix and by addressing differently the video information to the column driver. In the following specification, the row driver is called first driver because a same output of this driver can select luminous elements belonging to a group of rows and the column driver is called second driver because two outputs of this driver can deliver simultaneously video information to luminous elements belonging to a same column of the matrix. The internal structure of the first and second drivers is identical to the one of classical row and column drivers and is well known from the man skilled in the art.

Figure 1:
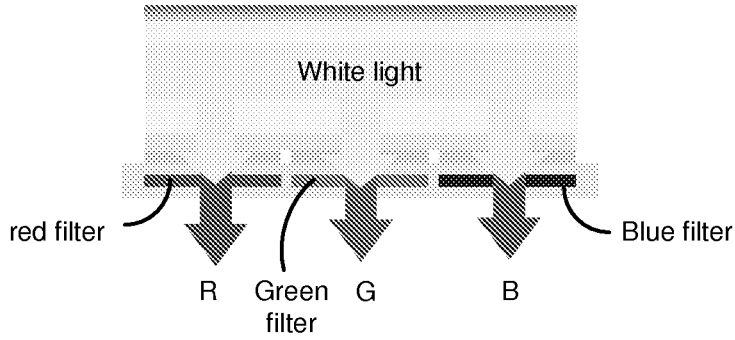
FIG. 1 shows a white OLED emitter having 3 colour filters for generating the red, green and blue colours.
Figure 2:
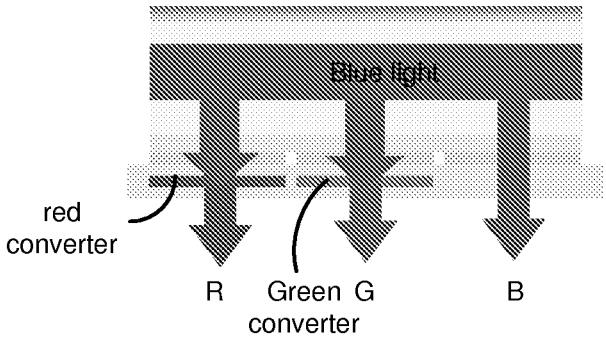
FIG. 2 shows a blue OLED emitter having 2 colour converters for generating the red, green and blue colours.
Figure 3:
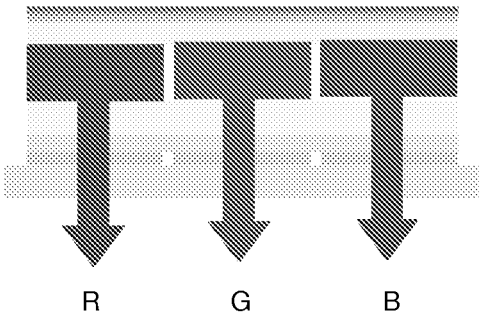
FIG. 3 shows a red OLED emitter, a green OLED emitter and a blue OLED emitter for generating the red, green and blue colours.
Figure 4:
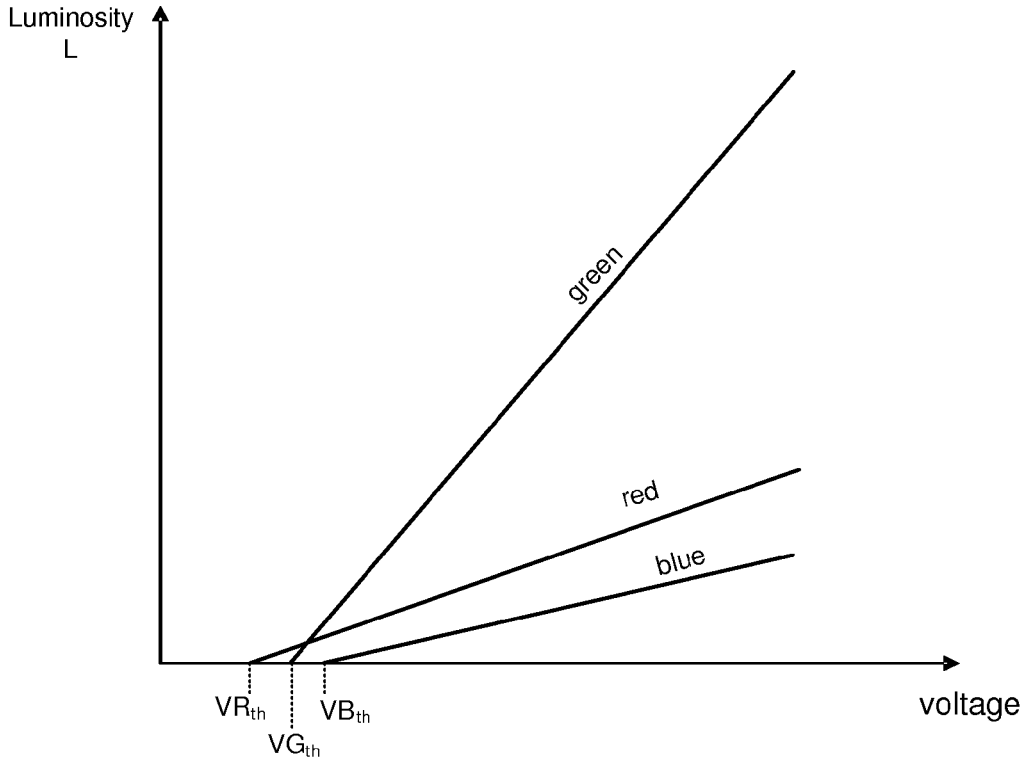
FIG. 4 is a schematic diagram illustrating the threshold voltages and the efficiencies of blue, green and red OLED materials.
Figure 5:
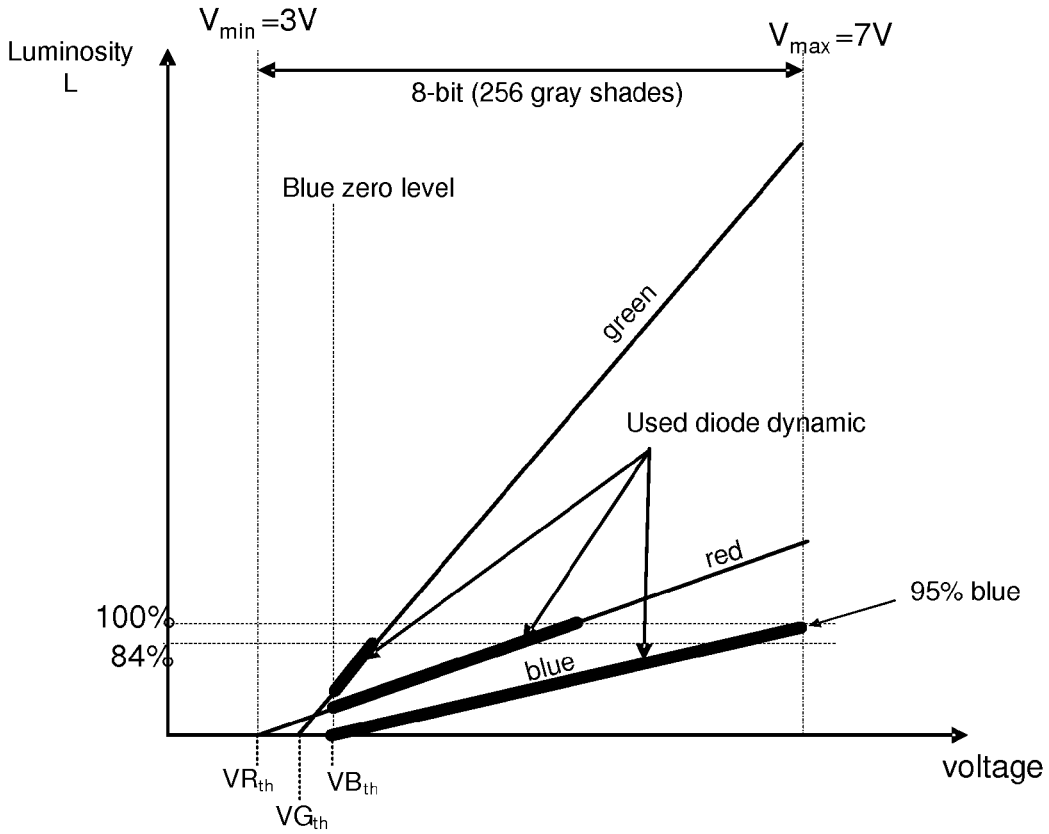
FIG. 5 shows the video range used for each blue, green and red OLED material of FIG. 4.
Figure 6:
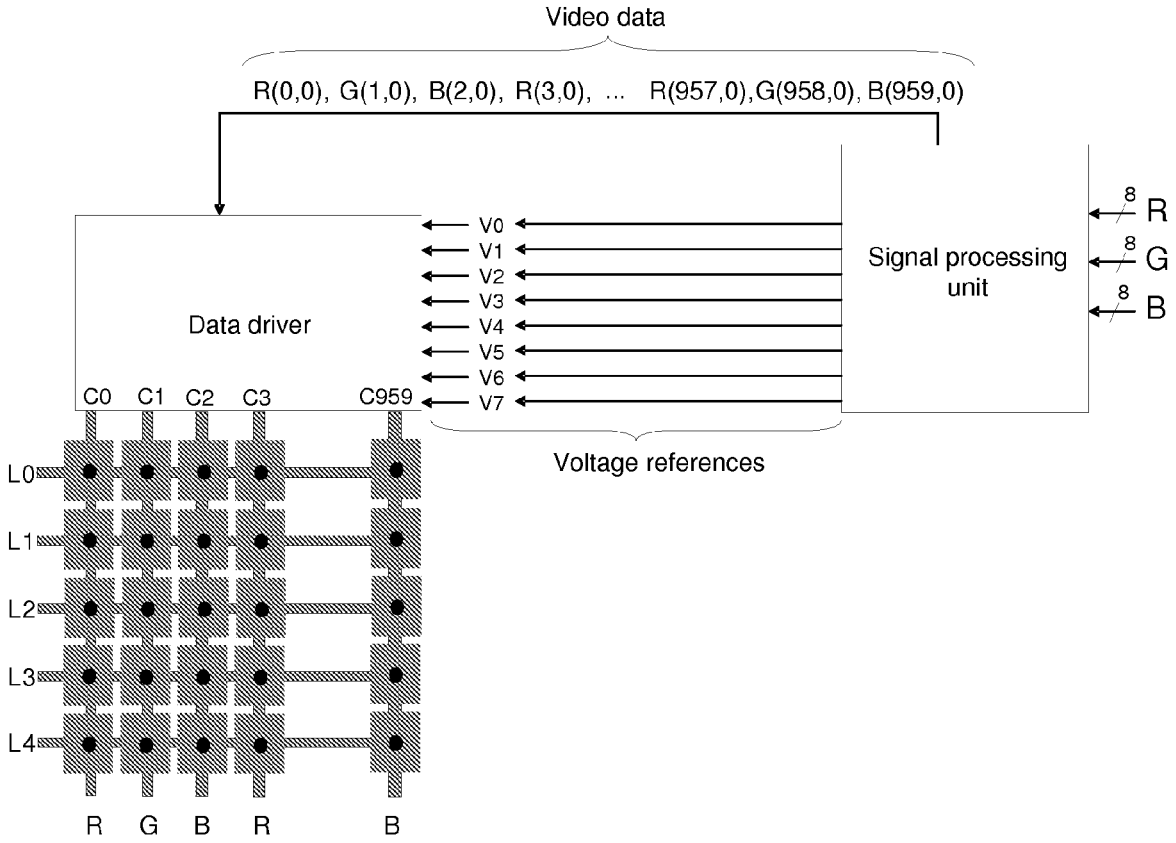
FIG.6 (prior art)
FIG. 6 illustrates the standard addressing of video data in an AMOLED display.
Figure 7:
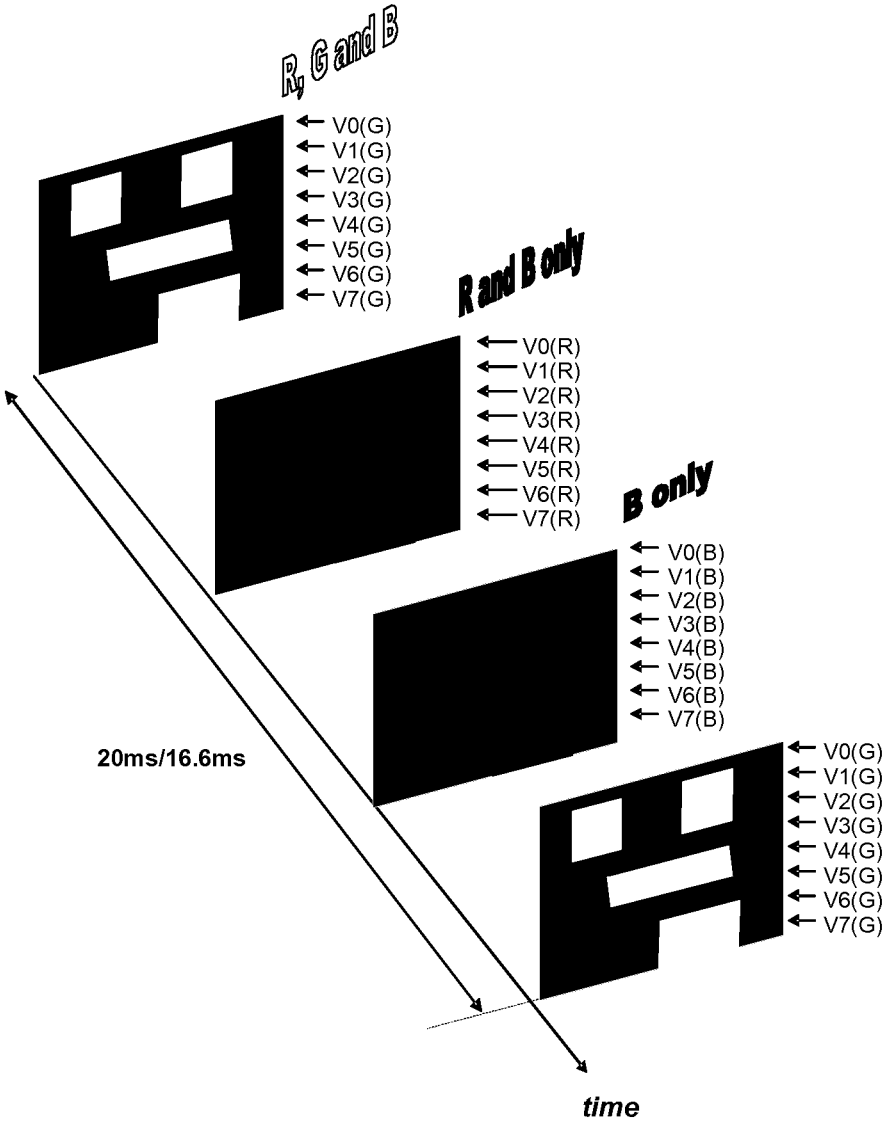
FIG.7 Prior Art
FIG. 7 illustrates the addressing of video data in an AMOLED display in prior art.
Figure 8:
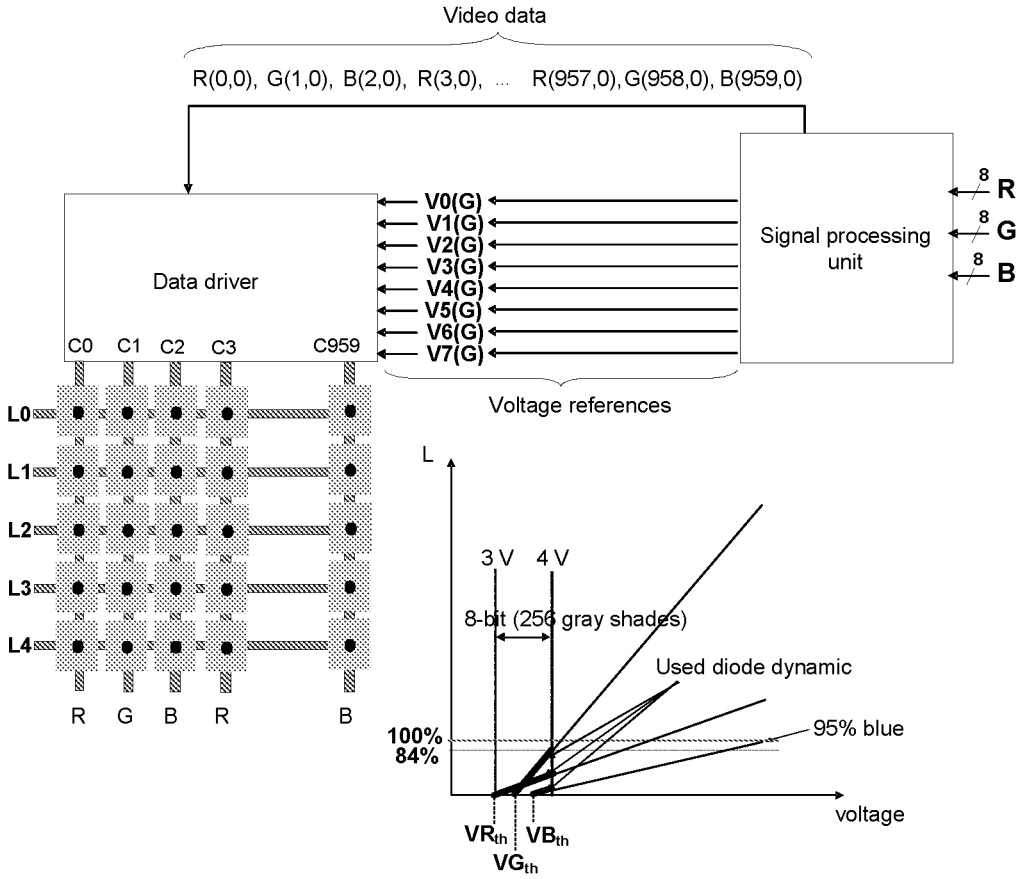
FIG.8 Prior Art
FIG. 8 illustrates the addressing of video data in an AMOLED display during a first sub-frame of the video frame in accordance with FIG. 7.
Figure 9:
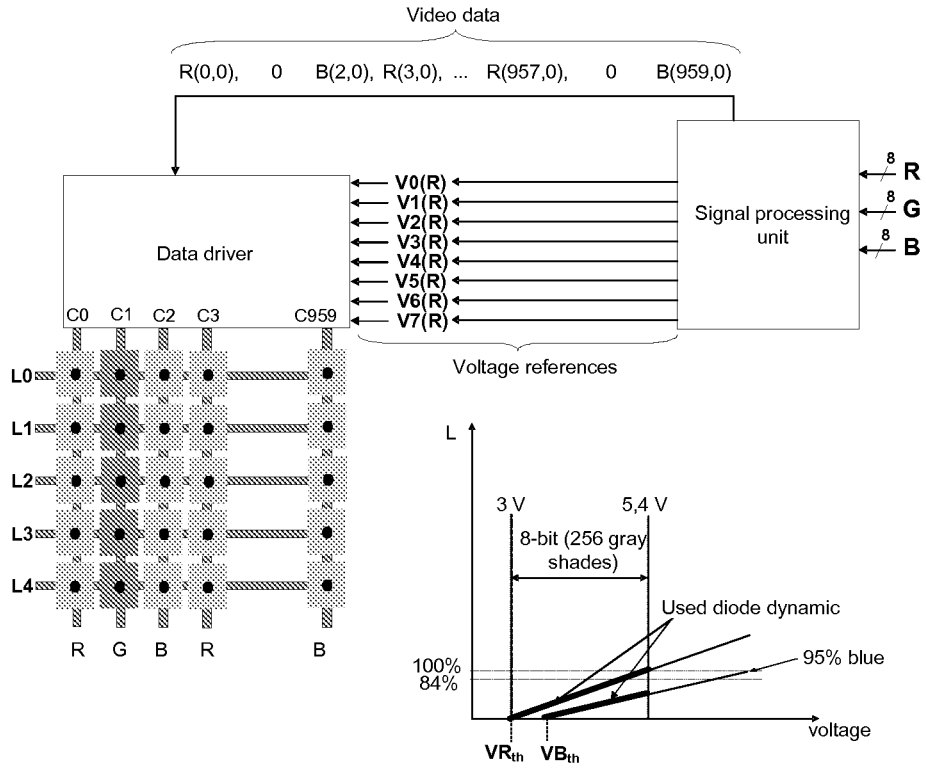
FIG.9 Prior Art
FIG. 9 illustrates the addressing of video data in an AMOLED display during a second sub-frame of the video frame in accordance with FIG. 7.
Figure 10:
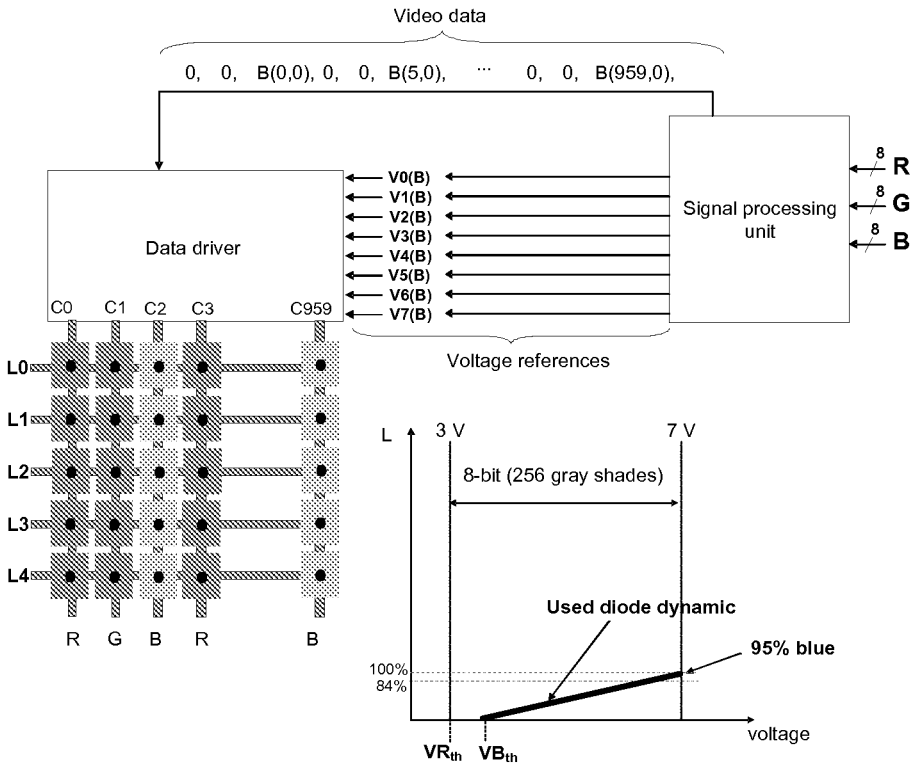
FIG.10 Prior Art
FIG. 10 illustrates the addressing of video data in an AMOLED display during a third sub-frame of the video frame in accordance with FIG. 7.
Figure 11:
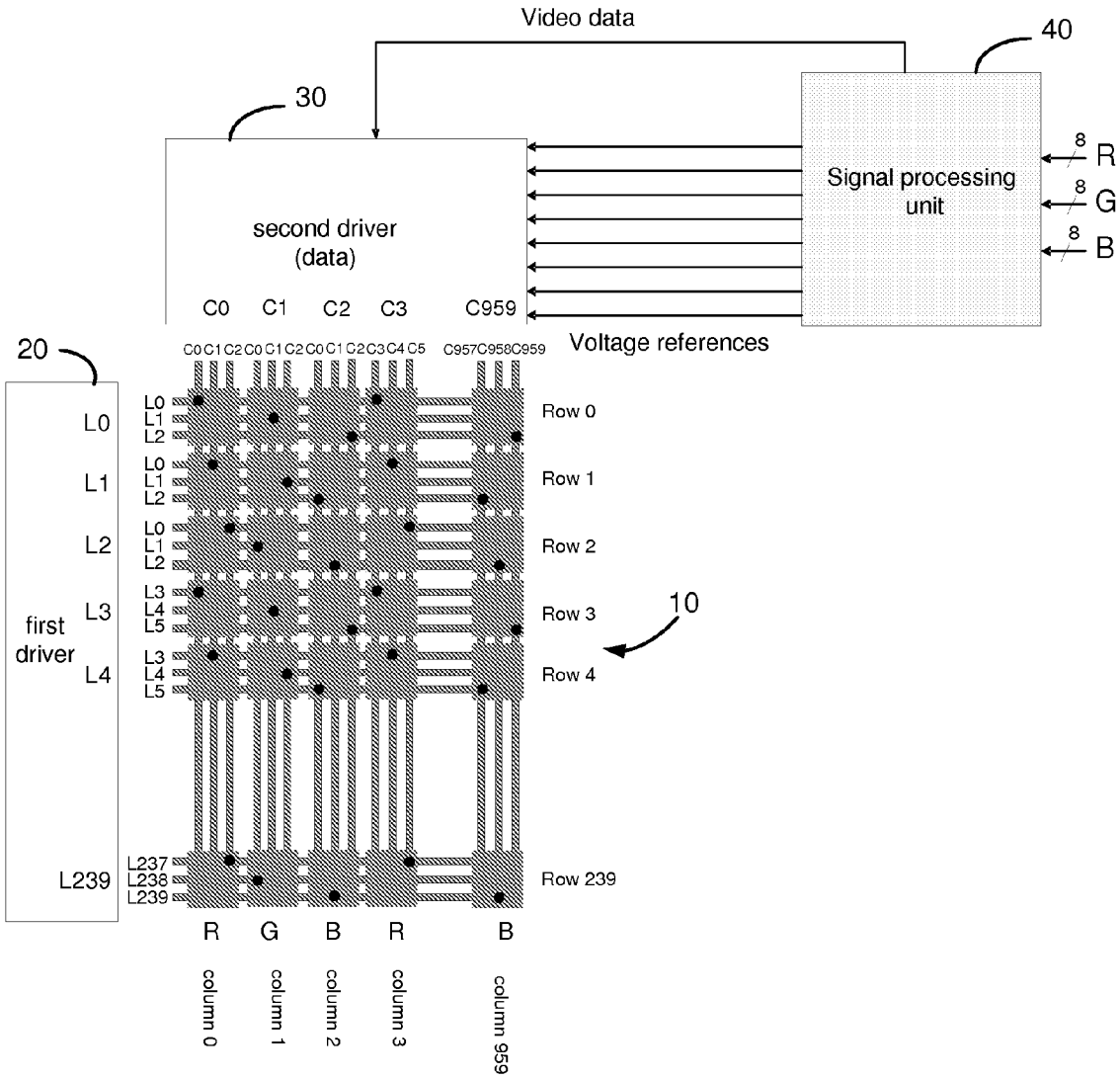
FIG. 11 illustrates the connection of the first driver (row driver) and the second driver (data driver) to the active matrix according to the invention.

FIG. 11 shows a display device comprising a QVGA matrix 10 of luminous elements arranged in 240 rows and 320×3 columns, a first driver 20 comprising 240 outputs L0 to L239 for selecting luminous elements of the matrix, a second driver 30 comprising 960 (=320×3) outputs C0 to C959 connected to the luminous elements of the matrix and a video processing unit 40 for delivering video information and a set of reference voltages to the second driver. The first column of the matrix comprises only red luminous elements, the second column comprises only green luminous elements, the third column comprises only blue luminous elements, the fourth column comprises only red luminous elements and so on. A first way of connecting the outputs L0 to L239 of the driver 20 and the outputs C0 to C959 of the driver 30 to the luminous elements of the matrix 10 is illustrated by FIG. 11. The connection of a luminous element to an output Ci of the second driver and an output Lj of the first driver is shown by a black point placed at the intersection of a column line connected to the output Ci and a row line connected to the output Lj. For example, the driver outputs C0 and L0 are connected to the first luminous element of the first row of the matrix, the driver outputs C1 and L1 are connected to the second luminous element of the first row of the matrix and the driver outputs C2 and L2 are connected to the third luminous element of the first row of the matrix. In this figure, 3 row lines are connected to each output Lj of the driver 20 and 3 column lines are connected to each output Ci of the driver 30 and all these lines are rectilinear and go throughout the matrix of cells.

Figure 12:
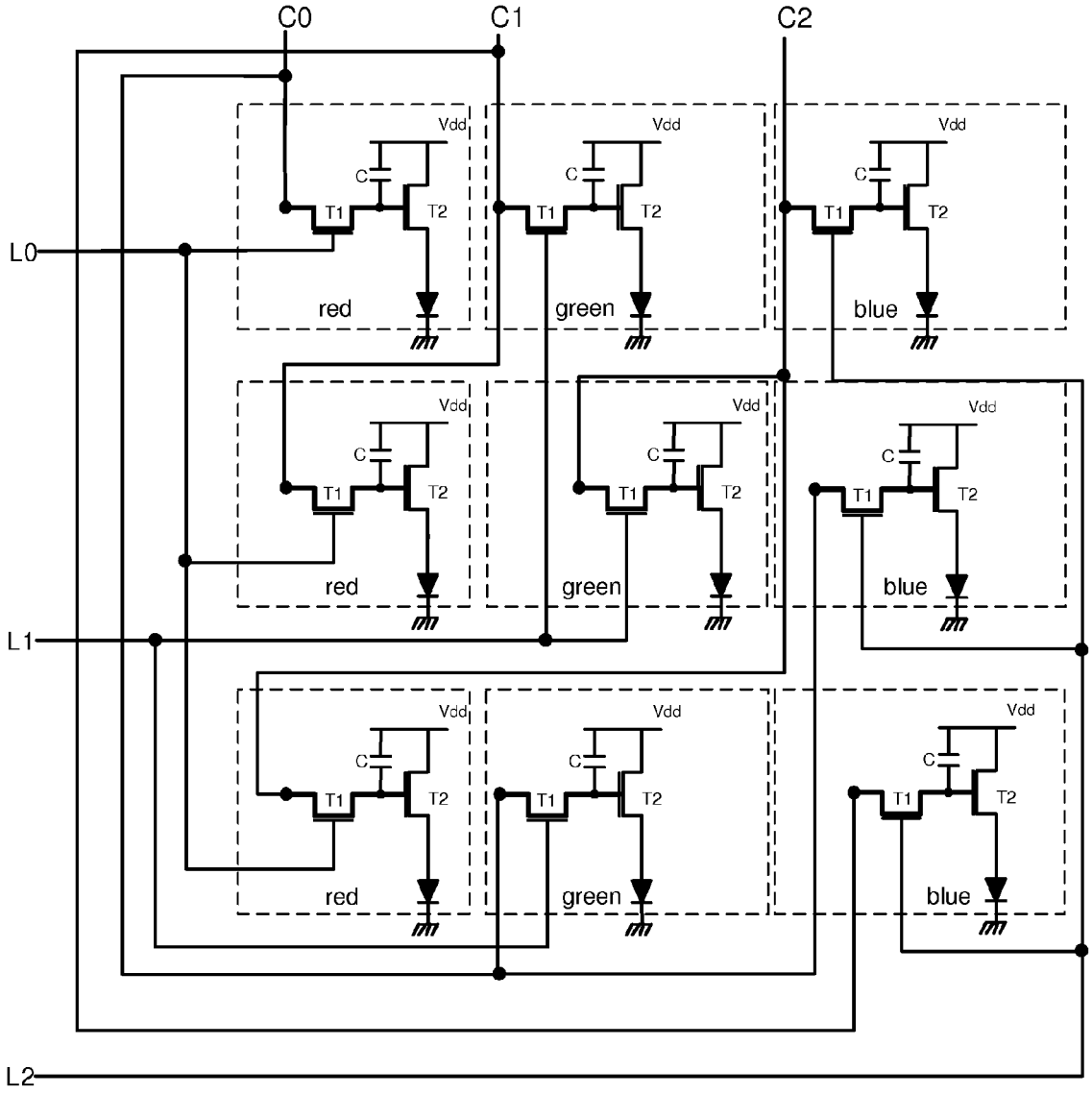
FIG. 12 shows a layout for a part of 3×3 luminous elements of the active matrix of FIG. 11.

FIG. 12 shows in more detail an example for connecting the driver outputs L0 to L2 and C0 to C2 to the first 3×3 luminous elements of the matrix. In this figure, each luminous element comprises an arrangement of two transistors T1 and T2, a capacitor and an organic light emitting diode (OLED). This arrangement is well known from the man skilled in the art. In a more general way, the driver output L0 is connected to all the red luminous elements of the three first rows of the matrix, the driver output L1 is connected to all the green luminous elements of the three first rows of the matrix and the driver output L2 is connected to all the blue luminous elements of the three first rows of the matrix. A separate output of the driver 30 is connected to each red luminous element of the three first rows of the matrix. The output C0 is connected to the first red luminous element of the first row of the matrix, the output C1 is connected to the first red luminous element of the second row of the matrix and the output C2 is connected to the first red luminous element of the third row of the matrix. For the green component, the output C1 is connected to the first green luminous element of the first row of the matrix, the output C2 is connected to the first green luminous element of the second row of the matrix and the output C0 is connected to the first green luminous element of the third row of the matrix. For the blue component, the output C2 is connected to the first blue luminous element of the first row of the matrix, the output C0 is connected to the first blue luminous element of the second row of the matrix and the output C1 is connected to the first blue luminous element of the third row of the matrix.

Figure 13:
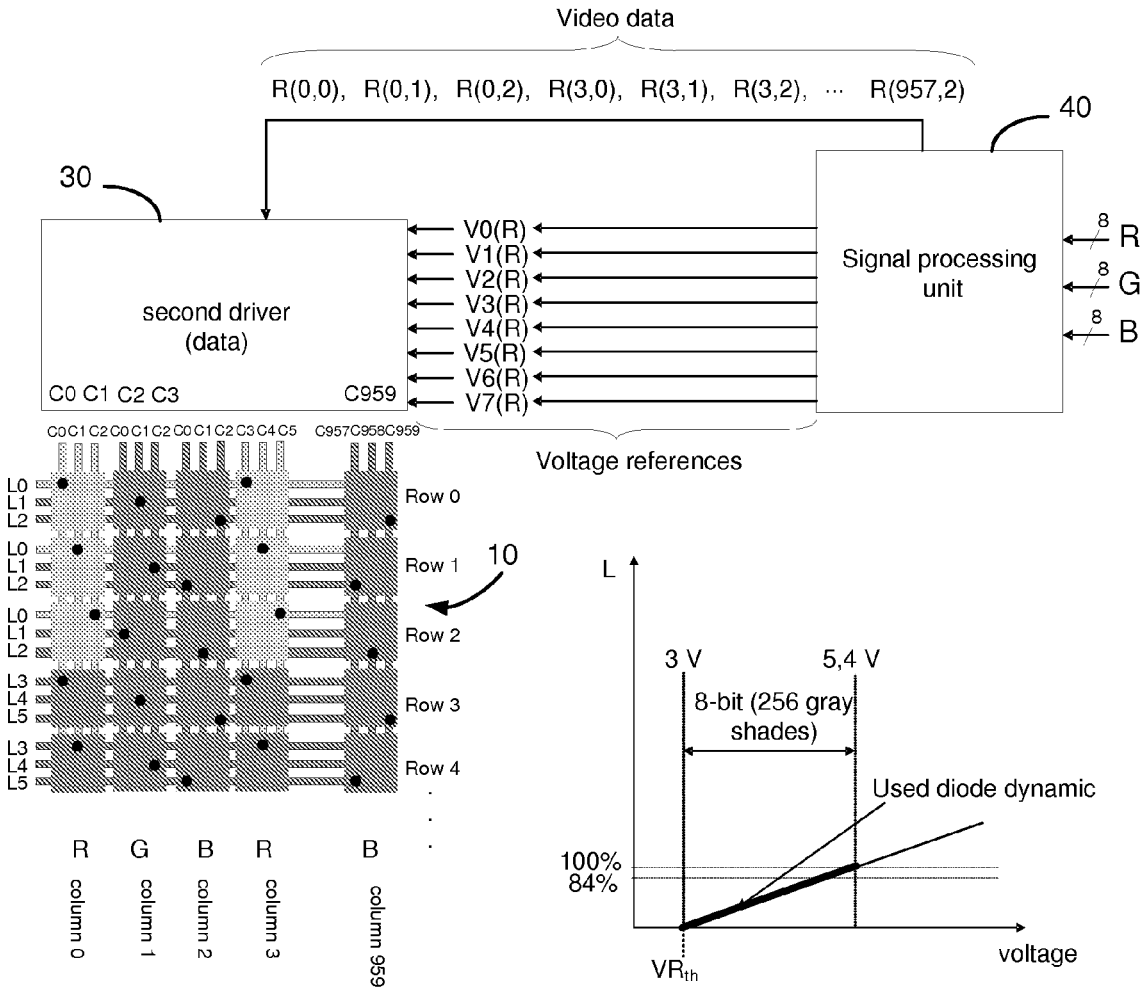
FIG. 13 illustrates the addressing of video data in the display device of FIG. 11 when the output L0 of the first driver is activated.

FIGS. 13 to 16 illustrate the functioning of the display device according to the invention. When displaying a picture, the driver 20 activates sequentially its outputs Lj. FIG. 13 shows the video information sent to the second driver 30 when the outputs L0 of the driver 20 is activated (ON). The red luminous elements of the three first rows (rows numbered 0, 1 and 2) of the matrix are thus selected. The video information R(0,0), R(0,1) R(0,2), R(3,0), R(3,1) R(3,2) . . . R(957,2) is sent to the driver 30. R(i,j) designates the piece of video information dedicated to the red luminous element belonging to the column i and the row j of the matrix. As only red luminous elements are selected when the output L0 is activated, the set of voltage references dedicated to the red component {V0(R), V1(R), V2(R), V3(R), V4(R), V5(R), V6(R), V7(R)} is sent also to the second driver 30. The video information is converted into voltages by the driver 30 and these voltages are applied to the selected luminous elements. The graph at the bottom-right corner of FIG. 13 shows the used diode dynamic when the output L0 is selected and when the set of reference voltages are distributed between 3 volts (=V7(R)=$VR_{th}$) and about 5.4 volts=V0(R) that is the maximum voltage that can be used for displaying the red component. The example of reference voltages given above in a table for the red component can be used.

Figure 14:
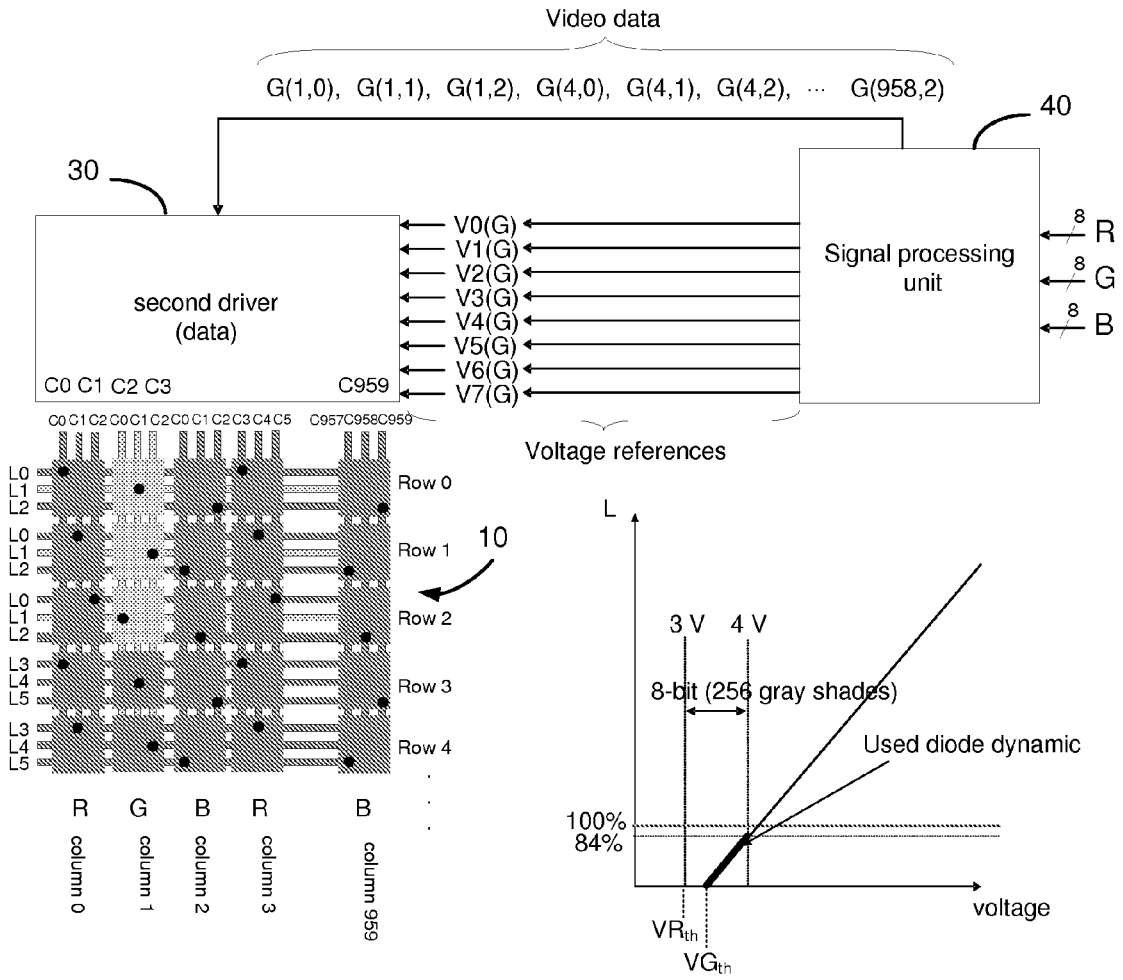
FIG. 14 illustrates the addressing of video data in the display device of FIG. 11 when the output L1 of the first driver is activated.

FIG. 14 shows the video information sent to the second driver 30 when the outputs L1 of the driver 20 is activated (ON). The green luminous elements of the three first rows of the matrix are thus selected. The video information G(1,0), G(111) G(1,2), G(4,0), G(4,1) G(4,2) . . . G(958,2) is sent to the driver 30. G(i,j) designates the piece of video information dedicated to the green luminous element belonging to the column i and the row j of the matrix. As only green luminous elements are selected when the output L1 is activated, the set of voltage references dedicated to the green component {V0(G), V1(G), V2(G), V3(G), V4(G), V5(G), V6(G), V7(G)} is sent also to the second driver 30. The video information is converted into voltages by the driver 30 and these voltages are applied to the selected luminous elements. The graph at the bottom-right corner of FIG. 14 shows the used diode dynamic when the output L1 is selected and when the set of reference voltages are distributed between 3 volts (=V7(G)=$VR_{th}$) and about 4 volts=V0(G) that is the maximum voltage that can be used for displaying the green component. The example of reference voltages given above in a table for the green component can be used.

Figure 15:
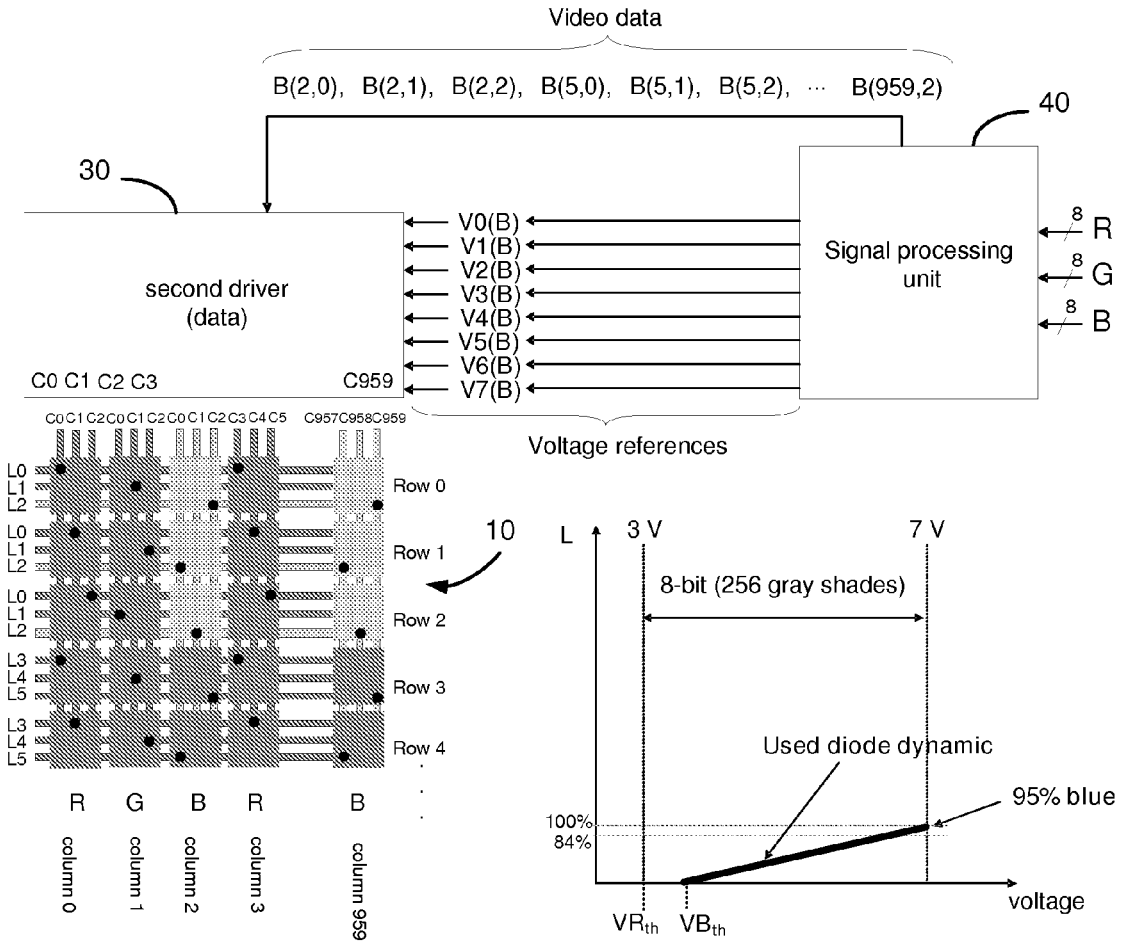
FIG. 15 illustrates the addressing of video data in the display device of FIG. 11 when the output L2 of the first driver is activated.

FIG. 15 shows the video information sent to the second driver 30 when the outputs L2 of the driver 20 is activated (ON). The blue luminous elements of the three first rows of the matrix are thus selected. The video information B(2,0), B(2,1) B(2,2), B(5,0), B(5,1) B(5,2) . . . B(959,2) is sent to the driver 30. B(i,j) designates the piece of video information dedicated to the blue luminous element belonging to the column i and the row j of the matrix. As only blue luminous elements are selected when the output L2 is activated, the set of voltage references dedicated to the blue component {V0(B), V1(B), V2(B), V3(B), V4(B), V5(B), V6(B), V7(B)} is sent also to the second driver 30. The video information is converted into voltages by the driver 30 and these voltages are applied to the selected luminous elements. The graph at the bottom-right corner of FIG. 15 shows the used diode dynamic when the output L2 is selected and when the set of reference voltages are distributed between 3 volts (=V7(B)=$VR_{th}$) and about 7 volts=V0(B) that is the maximum voltage that can be used for displaying the green component. The example of reference voltages given above in a table for the blue component can be used.

Figure 16:
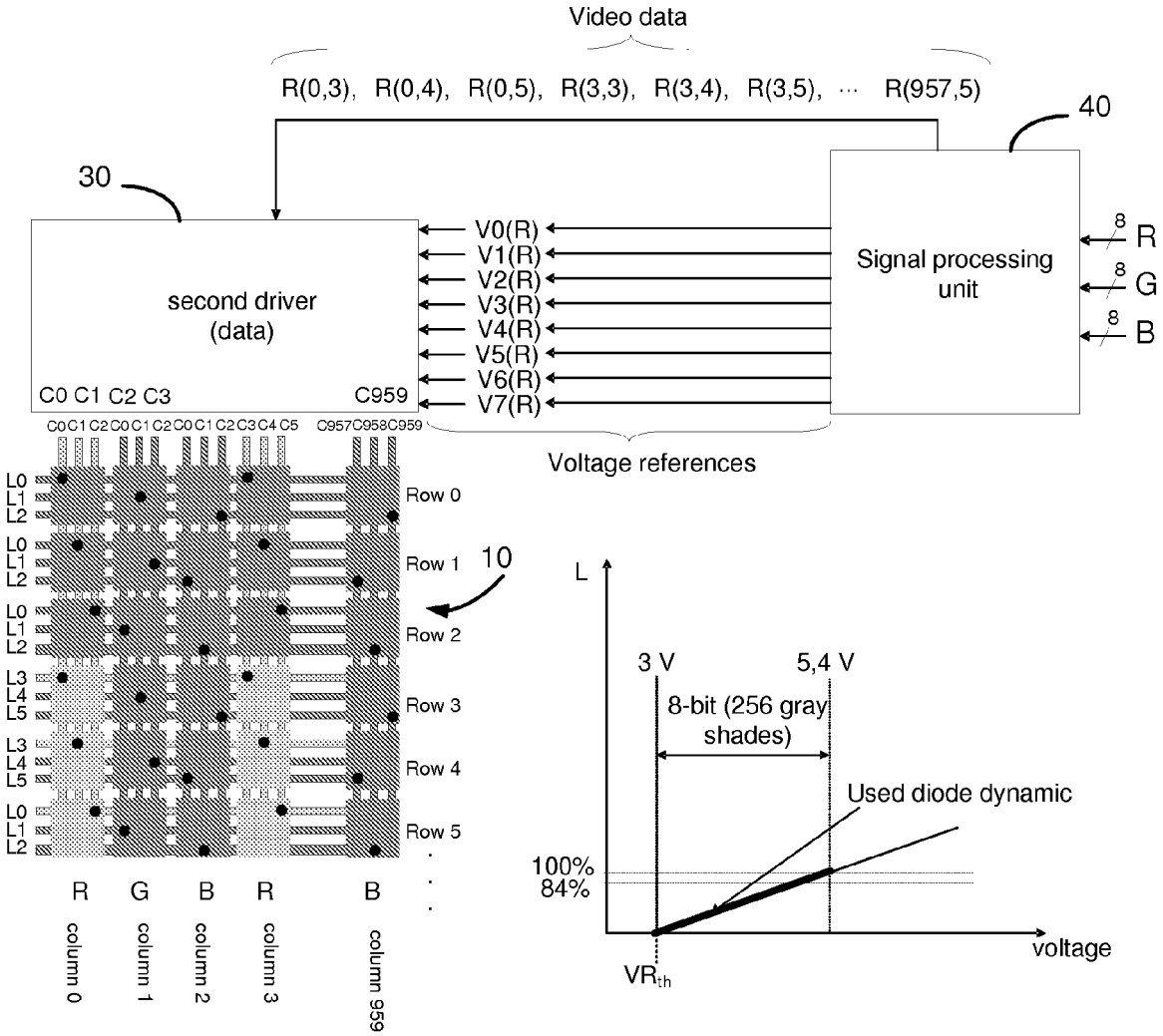
FIG. 16 illustrates the addressing of video data in the display device of FIG. 11 when the output L3 of the first driver is activated.

FIG. 16 shows the video information sent to the second driver 30 when the outputs L3 of the driver 20 is activated (ON). The red luminous elements of the fourth, fifth and sixth rows (rows numbered 3, 4 and 5) of the matrix are thus selected. The video information R(0,3), R(0,4) R(0,5), R(3,3), R(3,4) R(3,5) . . . R(957,5) is sent to the driver 30. As previously mentioned, R(i,j) designates the piece of video information dedicated to the red luminous element belonging to the column i and the row j of the matrix. As only red luminous elements are selected when the output L3 is activated, the set of voltage references dedicated to the red component {V0(R), V1(R), V2(R), V3(R), V4(R), V5(R), V6(R), V7(R)} is sent also to the second driver 30. The video information is converted into voltages by the driver 30 and these voltages are applied to the selected luminous elements. The graph at the bottom-right corner of FIG. 16 shows the used diode dynamic when the output L3 is selected and when the set of reference voltages are distributed between 3 volts (=V7(R)=$VR_{th}$) and about 5.4 volts=V0(G).

Figure 17:
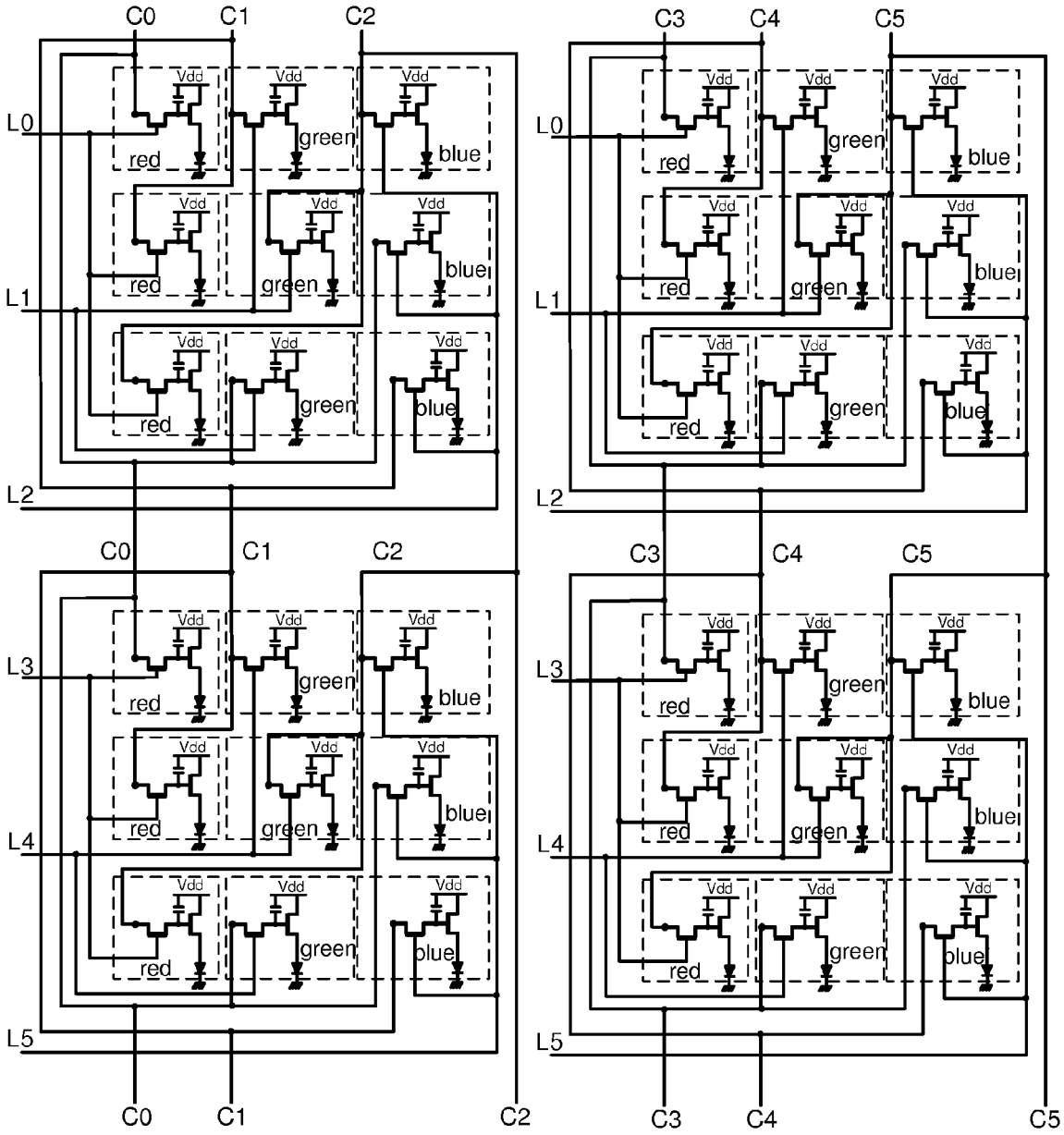
FIG. 17 shows a layout for 4 parts of 3×3 luminous elements of the active matrix.

The final matrix of the display device is based on a cyclical repetition of the basic 3×3 matrix presented FIG. 12 as illustrated by FIG. 17.

Generally speaking, a standard driver usage is kept according the invention. The outputs Lj of the driver 20 are activated sequentially and, at each time an output Lj is activated, video information are delivered on all outputs Ci of the driver 30.

On the other hand, FIG. 12 shows that there is a complex networking required to have the proper signal dedicated to the proper luminous element. In any case, there is no need of fast addressing as in the solution presented in the preamble of the present specification. A video data rearrangement is just needed in the signal processing unit 40. A permutation between the video data inside each 3×3 matrix is needed. This permutation can be the following one for a QVGA (320×3 columns and 240 rows of luminous elements):

Data(3*i*;3*j*)=>Data(3*i*;3*j*) (unchanged)

Data(3*i*+1;3*j*)=>Data(3*i*;3*j*+1)

Data(3*i*+2;3*j*)=>Data(3*i*;3*j*+2)

Data(3*i*;3*j*+1)=>Data(3*i*+1;3*j*)

Data(3*i*+1;3*j*+1)=>Data(3*i*+1;3*j*+1) (unchanged)

Data(3*i*+2;3*j*+1)=>Data(3*i*+1;3*j*+2)

Data(3*i*;3*j*+2)=>Data(3*i*+2;3*j*)

Data(3*i*+1;3*j*+2)=>Data(3*i*+2;3*j*+1)

Data(3*i*+2;3*j*+2)=>Data(3*i*+2;3*j*+2) (unchanged)

where Data (i,j) designates the data to be displayed by the luminous elements belonging to column i and row j of the matrix.

In summary, each output Lj activates the same colour component on three consecutive rows of the matrix. Then, the reference voltages (currents) are adjusted to the video information addressing so that each time a new output Lj is activated the corresponding reference voltages (currents) are transmitted to the driver 30.

Figure 18:
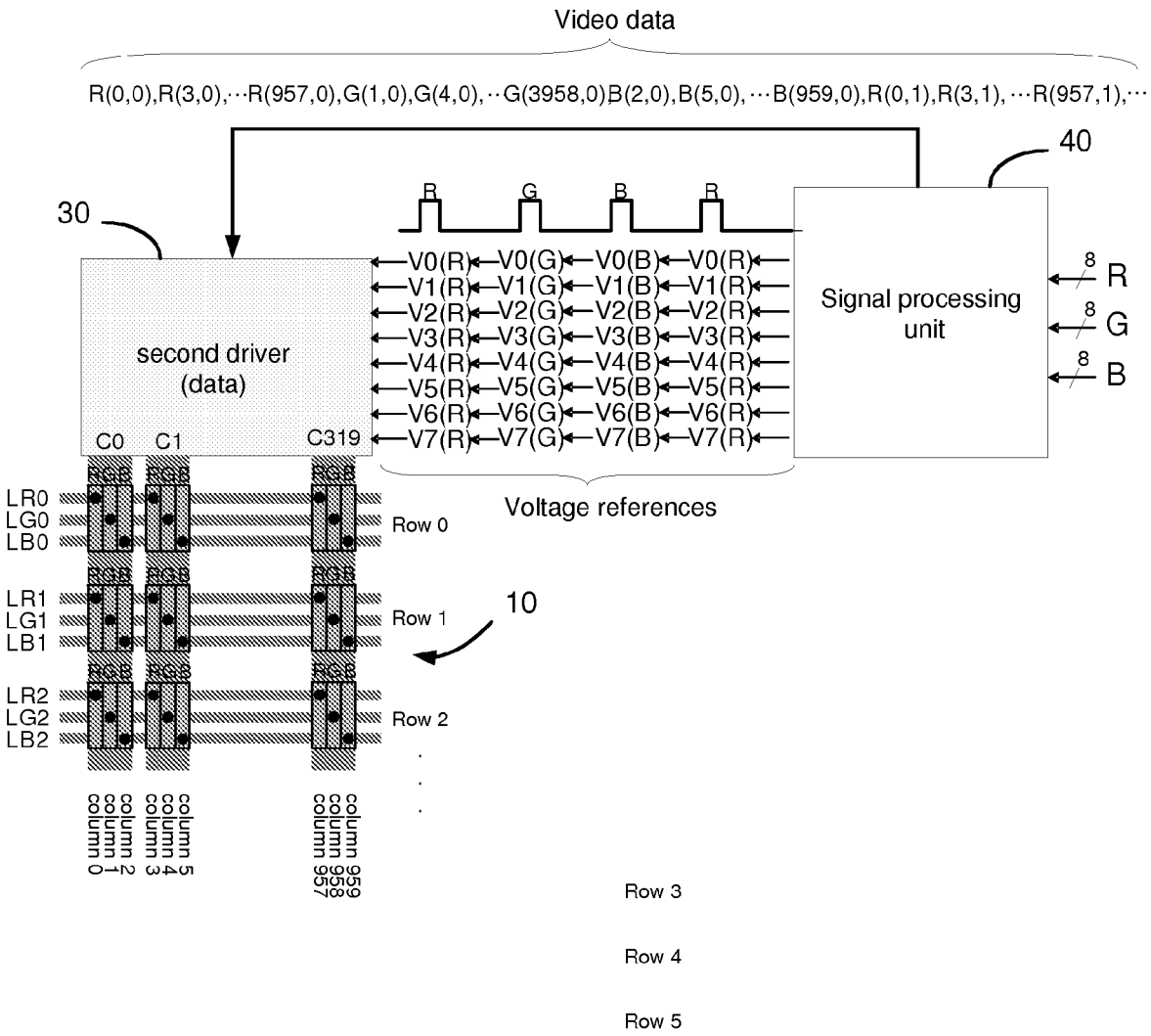
FIG. 18 illustrates a first variant of FIG. 11.

To reduce the cost of the display device, this matrix organization can be combined with a different second driver (data driver) that is less expensive. Indeed, the data drivers are the most expensive components whereas the row drivers are simpler and can be even integrated directly on the TFT-backplane (TFT=Thin Film Transistor) of the matrix. FIG. 18 illustrates a display device where the second driver 30 comprises only 320 outputs (instead of 3×320 outputs) and the first driver 20 comprises 240×3 outputs (instead of 240 outputs). The driver 20 comprises three times more outputs than previously but the driver 30 comprises three times less outputs than previously. The cost of the display device is reduced because the cost of the driver 30 is reduced. In this embodiment, 720 rows are sequentially addressed instead of 240 rows. The red luminous elements of the row j of the matrix are connected to the output LRj of the driver 20. The green luminous elements of the row j of the matrix are connected to the output LGj of the driver 20. The blue luminous elements of the row j of the matrix are connected to the output LBj of the driver 20. A same column output Ci is connected to three consecutive luminous elements connected to three different row outputs. In this embodiment, the flow of video information is rearranged differently.

Data(3*i*;*j*)=>Data(*i*;*j*)

Data(3*i*+1;*j*)=>Data(319+*i*;*j*)

Data(3*i*+2;*j*)=>Data(639+*i*;*j*)

In this embodiment, two consecutive outputs of the driver 20 are always connected to luminous elements associated to different colour components. For example, the output LR1 is consecutive to the output LB0 and LR1 is connected to red luminous elements while LB0 is connected to blue luminous elements.

Figure 19:
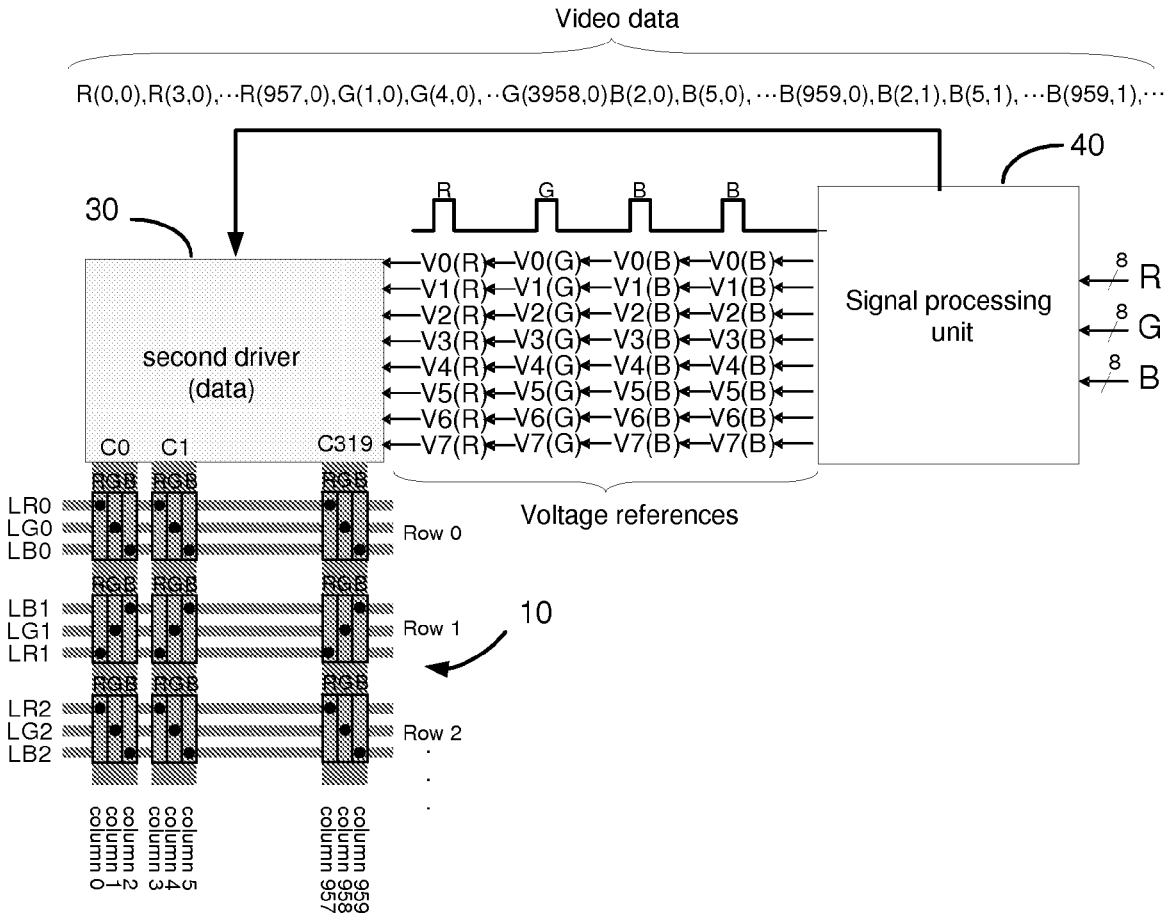
FIG. 19 illustrates a second variant of FIG. 11.

In a variant illustrated by FIG. 19, two consecutive outputs of the driver 20 are not always connected to luminous elements associated to different colour components. For example, the output LB1 is consecutive to the output LB0 and are both connected to blue luminous elements. In this embodiment, the flow of video information is rearranged differently.

for rows numbered j mod 6, j+1 mod 6 and j+2 mod 6, $\forall j \in \aleph$

Data(3*i*;*j*)=>Data(*i*;*j*)

Data(3*i*+1;*j*)=>Data(319+*i*;*j*)

Data(3*i*+2;*j*)=>Data(639+*i*;*j*)

for rows numbered j+3 mod 6, j+4 mod 6 and j+5 mod 6, $\forall j \in \aleph$

Data(3*i*;*j*)=>Data(639+*i*;*j*)

Data(3*i*+1;*j*)=>Data(319+*i*;*j*)

Data(3*i*+2;*j*)=>Data(*i*;*j*)

These two embodiments (FIGS. 18 and 19) have a reduced cost but require a higher addressing speed (3 times faster) since three times more rows must be addressed per frame.

Figure 20:
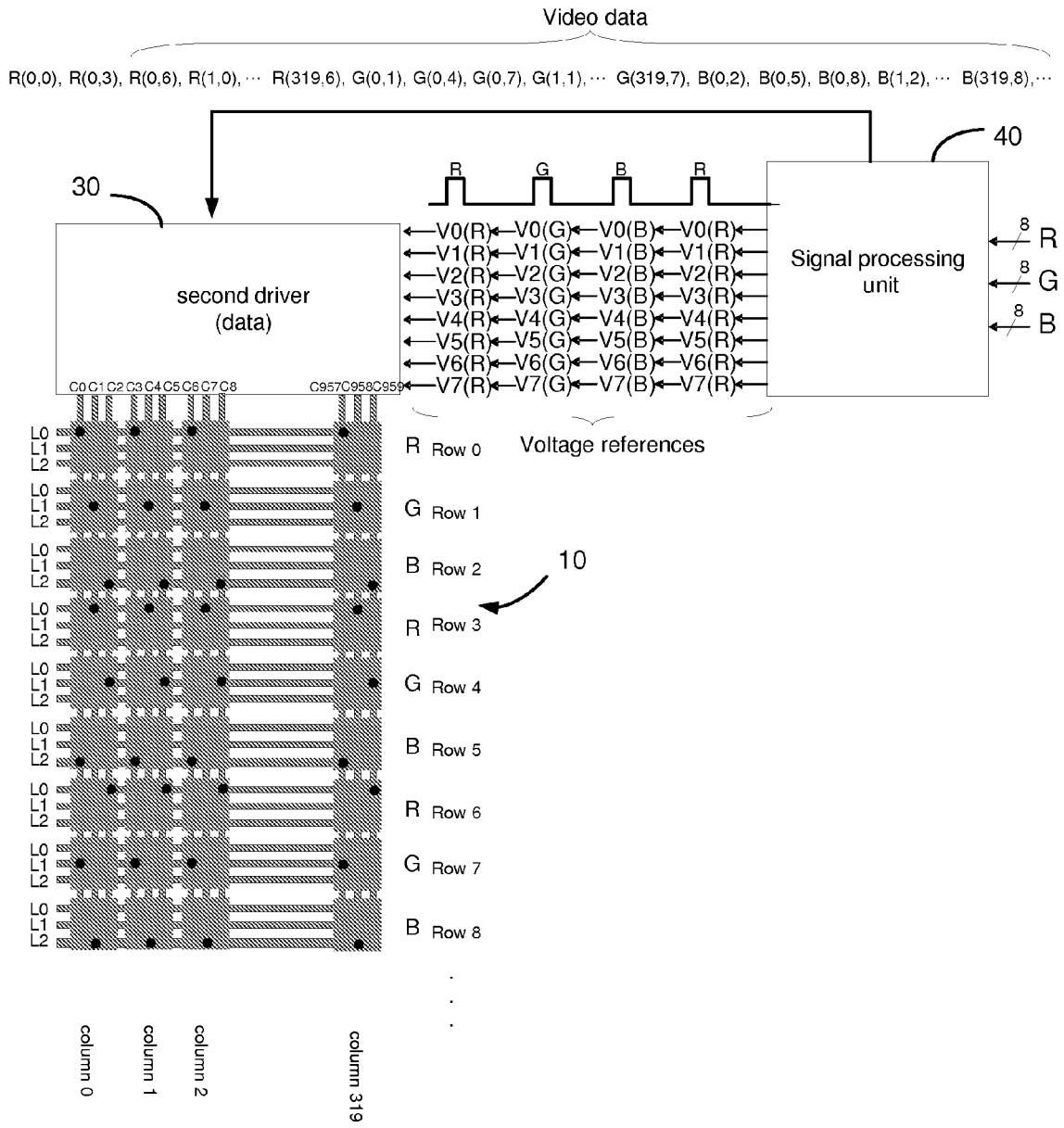
FIG. 20 illustrates a third variant of FIG. 11.

This matrix organization presented in the above-mentioned embodiments with a Red, Green, Blue standard alignment (all colour components on the same row of the matrix) requires a complex active matrix networking. A simplification of the layout of the active matrix can be obtained by using a vertical colour adjustment as illustrated by FIG. 20. In this figure, the luminous elements of the matrix ara arranged into 240×3 rows and 320 columns. All colour components (red, green, blue) are represented on a same column of the matrix. In this figure, the second driver 30 comprises 320×3=960 outputs and the first driver 20 comprises 240/3=80 outputs. The red luminous elements of a group of nine consecutive rows of the matrix are connected to the output Lj of the driver 20. The green luminous elements of this group of nine consecutive rows are connected to the output Lj+1 of the driver 20 and the blue luminous elements of the group of nine consecutive rows are connected to the output Lj+2 of the driver 20. A same column output Ci is connected to three luminous elements of said group of rows, each one of these luminous elements being connected to a different row output Lj. In this embodiment, the flow of video information is also rearranged.

The invention is not restricted to the disclosed embodiments. Various modifications are possible and are considered to fall within the scope of the claims, e.g. other OLED materials with other threshold voltages and efficiencies can be used.

ANNEX 1

| Level | Voltage |
|---|---|
| 0 | V7 |
| 1 | V7 + (V6 − V7) × 9/1175 |
| 2 | V7 + (V6 − V7) × 32/1175 |
| 3 | V7 + (V6 − V7) × 76/1175 |
| 4 | V7 + (V6 − V7) × 141/1175 |
| 5 | V7 + (V6 − V7) × 224/1175 |
| 6 | V7 + (V6 − V7) × 321/1175 |
| 7 | V7 + (V6 − V7) × 425/1175 |
| 8 | V7 + (V6 − V7) × 529/1175 |
| 9 | V7 + (V6 − V7) × 630/1175 |
| 10 | V7 + (V6 − V7) × 727/1175 |
| 11 | V7 + (V6 − V7) × 820/1175 |
| 12 | V7 + (V6 − V7) × 910/1175 |
| 13 | V7 + (V6 − V7) × 998/1175 |
| 14 | V7 + (V6 − V7) × 1086/1175 |
| 15 | V6 |
| 16 | V6 + (V5 − V6) × 89/1097 |
| 17 | V6 + (V5 − V6) × 173/1097 |
| 18 | V6 + (V5 − V6) × 250/1097 |
| 19 | V6 + (V5 − V6) × 320/1097 |
| 20 | V6 + (V5 − V6) × 386/1097 |
| 21 | V6 + (V5 − V6) × 451/1097 |
| 22 | V6 + (V5 − V6) × 517/1097 |
| 23 | V6 + (V5 − V6) × 585/1097 |
| 24 | V6 + (V5 − V6) × 654/1097 |
| 25 | V6 + (V5 − V6) × 723/1097 |
| 26 | V6 + (V5 − V6) × 790/1097 |
| 27 | V6 + (V5 − V6) × 855/1097 |
| 28 | V6 + (V5 − V6) × 917/1097 |
| 29 | V6 + (V5 − V6) × 977/1097 |
| 30 | V6 + (V5 − V6) × 1037/1097 |
| 31 | V5 |
| 32 | V5 + (V4 − V5) × 60/1501 |
| 33 | V5 + (V4 − V5) × 119/1501 |
| 34 | V5 + (V4 − V5) × 176/1501 |
| 35 | V5 + (V4 − V5) × 231/1501 |
| 36 | V5 + (V4 − V5) × 284/1501 |
| 37 | V5 + (V4 − V5) × 335/1501 |
| 38 | V5 + (V4 − V5) × 385/1501 |
| 39 | V5 + (V4 − V5) × 434/1501 |
| 40 | V5 + (V4 − V5) × 483/1501 |
| 41 | V5 + (V4 − V5) × 532/1501 |
| 42 | V5 + (V4 − V5) × 580/1501 |
| 43 | V5 + (V4 − V5) × 628/1501 |
| 44 | V5 + (V4 − V5) × 676/1501 |
| 45 | V5 + (V4 − V5) × 724/1501 |
| 46 | V5 + (V4 − V5) × 772/1501 |
| 47 | V5 + (V4 − V5) × 819/1501 |
| 48 | V5 + (V4 − V5) × 866/1501 |
| 49 | V5 + (V4 − V5) × 912/1501 |
| 50 | V5 + (V4 − V5) × 957/1501 |
| 51 | V5 + (V4 − V5) × 1001/1501 |
| 52 | V5 + (V4 − V5) × 1045/1501 |
| 53 | V5 + (V4 − V5) × 1088/1501 |
| 54 | V5 + (V4 − V5) × 1131/1501 |
| 55 | V5 + (V4 − V5) × 1173/1501 |
| 56 | V5 + (V4 − V5) × 1215/1501 |
| 57 | V5 + (V4 − V5) × 1257/1501 |
| 58 | V5 + (V4 − V5) × 1298/1501 |
| 59 | V5 + (V4 − V5) × 1339/1501 |
| 60 | V5 + (V4 − V5) × 1380/1501 |
| 61 | V5 + (V4 − V5) × 1421/1501 |
| 62 | V5 + (V4 − V5) × 1461/1501 |
| 63 | V4 |
| 64 | V4 + (V3 − V4) × 40/2215 |
| 65 | V4 + (V3 − V4) × 80/2215 |
| 66 | V4 + (V3 − V4) × 120/2215 |
| 67 | V4 + (V3 − V4) × 160/2215 |
| 68 | V4 + (V3 − V4) × 200/2215 |
| 69 | V4 + (V3 − V4) × 240/2215 |
| 70 | V4 + (V3 − V4) × 280/2215 |
| 71 | V4 + (V3 − V4) × 320/2215 |
| 72 | V4 + (V3 − V4) × 360/2215 |
| 73 | V4 + (V3 − V4) × 400/2215 |
| 74 | V4 + (V3 − V4) × 440/2215 |
| 75 | V4 + (V3 − V4) × 480/2215 |

-continued

ANNEX 1

| Level | Voltage |
|---|---|
| 76 | V4 + (V3 − V4) × 520/2215 |
| 77 | V4 + (V3 − V4) × 560/2215 |
| 78 | V4 + (V3 − V4) × 600/2215 |
| 79 | V4 + (V3 − V4) × 640/2215 |
| 80 | V4 + (V3 − V4) × 680/2215 |
| 81 | V4 + (V3 − V4) × 719/2215 |
| 82 | V4 + (V3 − V4) × 758/2215 |
| 83 | V4 + (V3 − V4) × 796/2215 |
| 84 | V4 + (V3 − V4) × 834/2215 |
| 85 | V4 + (V3 − V4) × 871/2215 |
| 86 | V4 + (V3 − V4) × 908/2215 |
| 87 | V4 + (V3 − V4) × 944/2215 |
| 88 | V4 + (V3 − V4) × 980/2215 |
| 89 | V4 + (V3 − V4) × 1016/2215 |
| 90 | V4 + (V3 − V4) × 1052/2215 |
| 91 | V4 + (V3 − V4) × 1087/2215 |
| 92 | V4 + (V3 − V4) × 1122/2215 |
| 93 | V4 + (V3 − V4) × 1157/2215 |
| 94 | V4 + (V3 − V4) × 1192/2215 |
| 95 | V4 + (V3 − V4) × 1226/2215 |
| 96 | V4 + (V3 − V4) × 1260/2215 |
| 97 | V4 + (V3 − V4) × 1294/2215 |
| 98 | V4 + (V3 − V4) × 1328/2215 |
| 99 | V4 + (V3 − V4) × 1362/2215 |
| 100 | V4 + (V3 − V4) × 1396/2215 |
| 101 | V4 + (V3 − V4) × 1429/2215 |
| 102 | V4 + (V3 − V4) × 1462/2215 |
| 103 | V4 + (V3 − V4) × 1495/2215 |
| 104 | V4 + (V3 − V4) × 1528/2215 |
| 105 | V4 + (V3 − V4) × 1561/2215 |
| 106 | V4 + (V3 − V4) × 1593/2215 |
| 107 | V4 + (V3 − V4) × 1625/2215 |
| 108 | V4 + (V3 − V4) × 1657/2215 |
| 109 | V4 + (V3 − V4) × 1688/2215 |
| 110 | V4 + (V3 − V4) × 1719/2215 |
| 111 | V4 + (V3 − V4) × 1750/2215 |
| 112 | V4 + (V3 − V4) × 1781/2215 |
| 113 | V4 + (V3 − V4) × 1811/2215 |
| 114 | V4 + (V3 − V4) × 1841/2215 |
| 115 | V4 + (V3 − V4) × 1871/2215 |
| 116 | V4 + (V3 − V4) × 1901/2215 |
| 117 | V4 + (V3 − V4) × 1930/2215 |
| 118 | V4 + (V3 − V4) × 1959/2215 |
| 119 | V4 + (V3 − V4) × 1988/2215 |
| 120 | V4 + (V3 − V4) × 2016/2215 |
| 121 | V4 + (V3 − V4) × 2044/2215 |
| 122 | V4 + (V3 − V4) × 2072/2215 |
| 123 | V4 + (V3 − V4) × 2100/2215 |
| 124 | V4 + (V3 − V4) × 2128/2215 |
| 125 | V4 + (V3 − V4) × 2156/2215 |
| 126 | V4 + (V3 − V4) × 2185/2215 |
| 127 | V3 |
| 128 | V3 + (V2 − V3) × 31/2343 |
| 129 | V3 + (V2 − V3) × 64/2343 |
| 130 | V3 + (V2 − V3) × 97/2343 |
| 131 | V3 + (V2 − V3) × 130/2343 |
| 132 | V3 + (V2 − V3) × 163/2343 |
| 133 | V3 + (V2 − V3) × 196/2343 |
| 134 | V3 + (V2 − V3) × 229/2343 |
| 135 | V3 + (V2 − V3) × 262/2343 |
| 136 | V3 + (V2 − V3) × 295/2343 |
| 137 | V3 + (V2 − V3) × 328/2343 |
| 138 | V3 + (V2 − V3) × 361/2343 |
| 139 | V3 + (V2 − V3) × 395/2343 |
| 140 | V3 + (V2 − V3) × 429/2343 |
| 141 | V3 + (V2 − V3) × 463/2343 |
| 142 | V3 + (V2 − V3) × 497/2343 |
| 143 | V3 + (V2 − V3) × 531/2343 |
| 144 | V3 + (V2 − V3) × 566/2343 |
| 145 | V3 + (V2 − V3) × 601/2343 |
| 146 | V3 + (V2 − V3) × 636/2343 |
| 147 | V3 + (V2 − V3) × 671/2343 |
| 148 | V3 + (V2 − V3) × 706/2343 |
| 149 | V3 + (V2 − V3) × 741/2343 |
| 150 | V3 + (V2 − V3) × 777/2343 |
| 151 | V3 + (V2 − V3) × 813/2343 |

-continued

ANNEX 1

| Level | Voltage |
|---|---|
| 152 | V3 + (V2 − V3) × 849/2343 |
| 153 | V3 + (V2 − V3) × 885/2343 |
| 154 | V3 + (V2 − V3) × 921/2343 |
| 155 | V3 + (V2 − V3) × 958/2343 |
| 156 | V3 + (V2 − V3) × 995/2343 |
| 157 | V3 + (V2 − V3) × 1032/2343 |
| 158 | V3 + (V2 − V3) × 1069/2343 |
| 159 | V3 + (V2 − V3) × 1106/2343 |
| 160 | V3 + (V2 − V3) × 1143/2343 |
| 161 | V3 + (V2 − V3) × 1180/2343 |
| 162 | V3 + (V2 − V3) × 1217/2343 |
| 163 | V3 + (V2 − V3) × 1255/2343 |
| 164 | V3 + (V2 − V3) × 1293/2343 |
| 165 | V3 + (V2 − V3) × 1331/2343 |
| 166 | V3 + (V2 − V3) × 1369/2343 |
| 167 | V3 + (V2 − V3) × 1407/2343 |
| 168 | V3 + (V2 − V3) × 1445/2343 |
| 169 | V3 + (V2 − V3) × 1483/2343 |
| 170 | V3 + (V2 − V3) × 1521/2343 |
| 171 | V3 + (V2 − V3) × 1559/2343 |
| 172 | V3 + (V2 − V3) × 1597/2343 |
| 173 | V3 + (V2 − V3) × 1635/2343 |
| 174 | V3 + (V2 − V3) × 1673/2343 |
| 175 | V3 + (V2 − V3) × 1712/2343 |
| 176 | V3 + (V2 − V3) × 1751/2343 |
| 177 | V3 + (V2 − V3) × 1790/2343 |
| 178 | V3 + (V2 − V3) × 1829/2343 |
| 179 | V3 + (V2 − V3) × 1868/2343 |
| 180 | V3 + (V2 − V3) × 1907/2343 |
| 181 | V3 + (V2 − V3) × 1946/2343 |
| 182 | V3 + (V2 − V3) × 1985/2343 |
| 183 | V3 + (V2 − V3) × 2024/2343 |
| 184 | V3 + (V2 − V3) × 2064/2343 |
| 185 | V3 + (V2 − V3) × 2103/2343 |
| 186 | V3 + (V2 − V3) × 2143/2343 |
| 187 | V3 + (V2 − V3) × 2183/2343 |
| 188 | V3 + (V2 − V3) × 2223/2343 |
| 189 | V3 + (V2 − V3) × 2263/2343 |
| 190 | V3 + (V2 − V3) × 2303/2343 |
| 191 | V2 |
| 192 | V2 + (V1 − V2) × 40/1638 |
| 193 | V2 + (V1 − V2) × 81/1638 |
| 194 | V2 + (V1 − V2) × 124/1638 |
| 195 | V2 + (V1 − V2) × 168/1638 |
| 196 | V2 + (V1 − V2) × 213/1638 |
| 197 | V2 + (V1 − V2) × 259/1638 |
| 198 | V2 + (V1 − V2) × 306/1638 |
| 199 | V2 + (V1 − V2) × 353/1638 |
| 200 | V2 + (V1 − V2) × 401/1638 |
| 201 | V2 + (V1 − V2) × 450/1638 |
| 202 | V2 + (V1 − V2) × 499/1638 |
| 203 | V2 + (V1 − V2) × 548/1638 |
| 204 | V2 + (V1 − V2) × 597/1638 |
| 205 | V2 + (V1 − V2) × 646/1638 |
| 206 | V2 + (V1 − V2) × 695/1638 |
| 207 | V2 + (V1 − V2) × 745/1638 |
| 208 | V2 + (V1 − V2) × 795/1638 |
| 209 | V2 + (V1 − V2) × 846/1638 |
| 210 | V2 + (V1 − V2) × 897/1638 |
| 211 | V2 + (V1 − V2) × 949/1638 |
| 212 | V2 + (V1 − V2) × 1002/1638 |
| 213 | V2 + (V1 − V2) × 1056/1638 |
| 214 | V2 + (V1 − V2) × 1111/1638 |
| 215 | V2 + (V1 − V2) × 1167/1638 |
| 216 | V2 + (V1 − V2) × 1224/1638 |
| 217 | V2 + (V1 − V2) × 1281/1638 |
| 218 | V2 + (V1 − V2) × 1339/1638 |
| 219 | V2 + (V1 − V2) × 1398/1638 |
| 220 | V2 + (V1 − V2) × 1458/1638 |
| 221 | V2 + (V1 − V2) × 1518/1638 |
| 222 | V2 + (V1 − V2) × 1578/1638 |
| 223 | V1 |
| 224 | V1 + (V0 − V1) × 60/3029 |
| 225 | V1 + (V0 − V1) × 120/3029 |
| 226 | V1 + (V0 − V1) × 180/3029 |
| 227 | V1 + (V0 − V1) × 241/3029 |

-continued

ANNEX 1

| Level | Voltage |
|---|---|
| 228 | V1 + (V0 − V1) × 304/3029 |
| 229 | V1 + (V0 − V1) × 369/3029 |
| 230 | V1 + (V0 − V1) × 437/3029 |
| 231 | V1 + (V0 − V1) × 507/3029 |
| 232 | V1 + (V0 − V1) × 580/3029 |
| 233 | V1 + (V0 − V1) × 655/3029 |
| 234 | V1 + (V0 − V1) × 732/3029 |
| 235 | V1 + (V0 − V1) × 810/3029 |
| 236 | V1 + (V0 − V1) × 889/3029 |
| 237 | V1 + (V0 − V1) × 969/3029 |
| 238 | V1 + (V0 − V1) × 1050/3029 |
| 239 | V1 + (V0 − V1) × 1133/3029 |
| 240 | V1 + (V0 − V1) × 1218/3029 |
| 241 | V1 + (V0 − V1) × 1304/3029 |
| 242 | V1 + (V0 − V1) × 1393/3029 |
| 243 | V1 + (V0 − V1) × 1486/3029 |
| 244 | V1 + (V0 − V1) × 1583/3029 |
| 245 | V1 + (V0 − V1) × 1686/3029 |
| 246 | V1 + (V0 − V1) × 1794/3029 |
| 247 | V1 + (V0 − V1) × 1907/3029 |
| 248 | V1 + (V0 − V1) × 2026/3029 |
| 249 | V1 + (V0 − V1) × 2150/3029 |
| 250 | V1 + (V0 − V1) × 2278/3029 |
| 251 | V1 + (V0 − V1) × 2411/3029 |
| 252 | V1 + (V0 − V1) × 2549/3029 |
| 253 | V1 + (V0 − V1) × 2694/3029 |
| 254 | V1 + (V0 − V1) × 2851/3029 |
| 255 | V0 |

The invention claimed is:

1. Display device comprising an active matrix containing an array of luminous elements of k different colours arranged in a plurality of n rows and a plurality of m columns, each luminous element being associated to a colour component among the k different colour components of a picture to be displayed, k being greater than 1 and the luminous elements being arranged in groups of k consecutive luminous elements each associated to a different colour component, a first driver having outputs connected to the active matrix for selecting luminous elements belonging to the group of rows of the matrix, each output of the first driver being connected to a different part of the matrix and the parts of the matrix being selected by the first driver one after the other, a second driver having outputs connected to the active matrix for delivering simultaneously a signal to luminous elements belonging to a same column of the matrix and selected by the first driver, said signal depending on the video information to be displayed by the selected luminous elements; and a digital processing unit for delivering video information to the second driver and control signals to the first driver, wherein at least one output of the first driver is connected only to luminous elements associated to a same colour component in k groups of luminous elements belonging to the group of rows of the matrix, the signal of the video information to be displayed by each of the luminous elements connected to said at least one output of the first driver being delivered by a separate output of the second driver.

2. Display device according to claim 1, wherein the number of k luminous elements of each group belongs to one and the same row of luminous elements of the matrix.

3. Display device according to claim 1, wherein the first driver has a predetermined first number of outputs and the second driver has a predetermined second number of outputs.

4. Display device according to claim 1, wherein each output of the first driver is connected to all luminous elements associated to a same colour component and belonging to the number of k rows of luminous elements of the active matrix.

5. Display device according to claim 1, wherein each output of the first driver is connected to all luminous elements associated to a same colour component and belonging to a same row of luminous elements of the matrix and each output of the second driver is connected to the number of k luminous elements of a same group of luminous elements.

6. Display device according to claim 1, wherein two consecutive outputs of the first driver are connected to luminous elements associated to different colour components.

7. Display device according to claim 1, wherein at least two consecutive outputs of the first driver are connected to luminous elements associated to a same colour component.

8. Display device according to claim 1, wherein the number of k luminous elements of each group belongs to one and the same column of luminous elements of the active matrix.

9. Display device according to claim 1, wherein the number of k outputs of the second driver are connected to luminous elements of a same column, each one of said number of k outputs being connected to luminous elements associated to a same colour component and each output of the first driver is connected to all luminous elements associated to a same colour component and belonging to a same column of luminous elements and to the number of k rows of luminous elements of the active matrix.

10. Display device according to claim 1, wherein the video information delivered to the second driver is based on sets of reference signals, a different set of reference signals being associated to at least two different colour components and wherein the digital processing unit controls the first driver and delivers video information and reference signals to the second driver such that, each time the luminous elements connected to an output of the first driver are selected, the digital processing unit delivers to the second driver the video information of the luminous elements selected by the first driver and the set of reference signals associated to the colour component of the selected luminous elements.

* * * * *